US007604025B2

(12) United States Patent
Quigley

(10) Patent No.: US 7,604,025 B2
(45) Date of Patent: Oct. 20, 2009

(54) FORMING FABRIC HAVING OFFSET BINDING WARPS

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 212 days.

(21) Appl. No.: 11/615,708

(22) Filed: Dec. 22, 2006

(65) Prior Publication Data

US 2008/0149213 A1 Jun. 26, 2008

(51) Int. Cl.

| | |
|---|---|
| ***D21F 7/08*** | (2006.01) |
| ***D21F 7/12*** | (2006.01) |
| *D03D 23/00* | (2006.01) |
| *D03D 25/00* | (2006.01) |

(52) U.S. Cl. ..... 139/383 A; 139/383 AA; 139/383 R; 162/358.2

(58) Field of Classification Search ..... None
See application file for complete search history.

(56) References Cited

U.S. PATENT DOCUMENTS

| | | | | |
|---|---|---|---|---|
| 3,867,766 | A | 2/1975 | Wagner | |
| 4,224,372 | A * | 9/1980 | Romanski | 442/187 |
| 4,239,065 | A | 12/1980 | Trokhan | |
| 4,314,589 | A * | 2/1982 | Buchanan et al. | 139/383 A |
| 4,423,755 | A | 1/1984 | Thompson | |
| 4,501,303 | A * | 2/1985 | Osterberg | 139/425 A |
| 4,564,052 | A * | 1/1986 | Borel | 139/425 A |
| 4,832,090 | A * | 5/1989 | Krenkel et al. | 139/383 A |
| 5,101,866 | A | 4/1992 | Quigley | |
| 5,151,316 | A * | 9/1992 | Durkin et al. | 428/213 |
| 5,152,326 | A * | 10/1992 | Vohringer | 139/383 A |
| 5,324,248 | A | 6/1994 | Quigley | |
| 5,343,896 | A * | 9/1994 | Schroder et al. | 139/383 A |
| 5,429,686 | A | 7/1995 | Chiu et al. | |
| 5,437,315 | A | 8/1995 | Ward | |
| 5,456,293 | A | 10/1995 | Ostermayer et al. | |

(Continued)

FOREIGN PATENT DOCUMENTS

WO 02/00996 1/2002

(Continued)

OTHER PUBLICATIONS

Forms PCT/ISA/220, PCT/ISA/210 and PCT/ISAl237.

(Continued)

*Primary Examiner*—Bobby H Muromoto, Jr.
(74) *Attorney, Agent, or Firm*—Greenblum & Bernstein, P.L.C.

(57) ABSTRACT

Forming fabric that includes a top layer having a plurality of first top warp yarns woven with a plurality of top weft yarns. A bottom layer includes a plurality of first bottom warp yarns woven with a plurality of bottom weft yarns. A plurality of second top warp yarns is woven with some of the plurality of top weft yarns and with some of the plurality of bottom weft yarns. A plurality of second bottom warp yarns is woven with some of the plurality of top weft yarns and with some of the plurality of bottom weft yarns. At least one of the plurality of second top warp yarns weaves to the bottom layer with a short plain weave. At least one of the plurality of second bottom warp yarns weaves to the bottom layer with a short plain weave.

27 Claims, 8 Drawing Sheets

U.S. PATENT DOCUMENTS

| | | | | |
|---|---|---|---|---|
| 5,520,225 | A | 5/1996 | Quigley et al. | |
| 5,542,455 | A | 8/1996 | Ostermayer et al. | |
| 5,555,917 | A | 9/1996 | Quigley | |
| 5,694,980 | A | 12/1997 | Quigley | |
| 5,713,397 | A | 2/1998 | Quigley | |
| 5,731,059 | A | 3/1998 | Smith et al. | |
| 5,817,213 | A | 10/1998 | Ostermayer et al. | |
| 5,826,627 | A | 10/1998 | Seabrook et al. | |
| 5,840,411 | A * | 11/1998 | Stelljes et al. | 442/239 |
| 5,853,547 | A | 12/1998 | Ahrens et al. | |
| 5,945,357 | A | 8/1999 | Quigley | |
| 5,967,195 | A | 10/1999 | Ward | |
| 5,988,229 | A | 11/1999 | Quigley | |
| 6,148,869 | A | 11/2000 | Quigley | |
| 6,202,705 | B1 | 3/2001 | Johnson et al. | |
| 6,227,256 | B1 | 5/2001 | Quigley | |
| 6,237,644 | B1 | 5/2001 | Hay et al. | |
| 6,349,749 | B1 | 2/2002 | Quigley | |
| 6,530,398 | B1 | 3/2003 | Westerkamp | |
| 6,546,964 | B1 | 4/2003 | Westerkamp | |
| 6,581,645 | B1 | 6/2003 | Johnson et al. | |
| 6,592,714 | B2 | 7/2003 | Lamb | |
| 6,649,026 | B2 | 11/2003 | Lamb | |
| 6,834,684 | B2 | 12/2004 | Martin et al. | |
| 6,860,299 | B2 | 3/2005 | Kuji | |
| 6,926,043 | B2 | 8/2005 | Quigley et al. | |
| 6,953,065 | B2 * | 10/2005 | Martin et al. | 139/383 A |
| 6,959,737 | B2 | 11/2005 | Ward | |
| 6,978,809 | B2 | 12/2005 | Quigley | |
| 7,007,722 | B2 | 3/2006 | Quigley et al. | |
| 7,048,012 | B2 | 5/2006 | Martin et al. | |
| 7,059,357 | B2 | 6/2006 | Ward | |
| 7,059,359 | B2 | 6/2006 | Quigley et al. | |
| 2002/0056536 | A1 | 5/2002 | Lamb | |
| 2004/0020621 | A1 * | 2/2004 | Heger et al. | 162/348 |
| 2004/0079434 | A1 | 4/2004 | Martin et al. | |
| 2004/0182465 | A1 | 9/2004 | Ward | |
| 2004/0231745 | A1 | 11/2004 | Quigley et al. | |
| 2004/0238062 | A1 | 12/2004 | Quigley et al. | |
| 2005/0051230 | A1 * | 3/2005 | Martin et al. | 139/383 R |
| 2005/0067040 | A1 | 3/2005 | Quigley | |
| 2005/0103397 | A1 | 5/2005 | Quigley et al. | |
| 2005/0139281 | A1 | 6/2005 | Martin et al. | |
| 2005/0167066 | A1 | 8/2005 | Herman et al. | |
| 2006/0009582 | A1 | 1/2006 | Zhang et al. | |
| 2006/0016505 | A1 | 1/2006 | Westerkamp | |
| 2006/0016509 | A1 | 1/2006 | Westerkamp | |
| 2006/0048840 | A1 | 3/2006 | Quigley | |
| 2006/0060321 | A1 | 3/2006 | Quigley et al. | |
| 2006/0063451 | A1 | 3/2006 | Serr et al. | |
| 2006/0085999 | A1 | 4/2006 | Scherb et al. | |
| 2006/0219312 | A1 | 10/2006 | Hay et al. | |
| 2006/0243338 | A1 | 11/2006 | Hawes et al. | |
| 2006/0278294 | A1 | 12/2006 | Quigley | |
| 2007/0006934 | A1 | 1/2007 | Quigley et al. | |
| 2007/0006935 | A1 | 1/2007 | Quigley et al. | |
| 2007/0028996 | A1 | 2/2007 | Quigley | |
| 2007/0215304 | A1 | 9/2007 | Lippi Alves Fernandes et al. | |
| 2007/0240842 | A1 | 10/2007 | Scherb et al. | |
| 2007/0251659 | A1 | 11/2007 | Fernandes et al. | |
| 2007/0251660 | A1 | 11/2007 | Walkenhaus et al. | |
| 2007/0272385 | A1 | 11/2007 | Quigley et al. | |

FOREIGN PATENT DOCUMENTS

| | | |
|---|---|---|
| WO | 2005/035867 | 4/2005 |
| WO | 2005/075732 | 8/2005 |
| WO | 2005/075737 | 8/2005 |
| WO | 2006/113818 | 10/2006 |

OTHER PUBLICATIONS

Applicant also herein submits a co-pending U.S. Appl. No. 11/615,611.

* cited by examiner

Fig. 1

| | | | | | | | | | | | | |
|---|---|---|---|---|---|---|---|---|---|---|---|---|
| | X | □ | X | | X | | X | □ | X | | X | 36 |
| | X | A | X′ | A′ | X | A | | | XX′ | B′A′ | | 34 35 |
| A | | A | | B | | A | | A | | B | | 33 |
| A | XX′ | B′ | | B | X | | X′ | AB | X | | | 31 32 |
| □ | X | | X | | X | □ | X | | X | | X | 30 |
| B | | | X | B′A′ | X′ | | X | A | | A′ | XX′ | 28 29 |
| B | | A | | B | | B | | A | | B | | 27 |
| | | AB | XX′ | | | B | X | B′ | X′ | B | X | 25 26 |
| | X | | X | □ | X | | X | | X | □ | X | 24 |
| A′ | X | A | | | XX′ | B′A′ | | | X | A | X′ | 22 23 |
| B | | A | | A | | B | | A | | A | | 21 |
| B | X | | X′ | AB | X | | | A | XX′ | B′ | | 19 20 |
| | X | □ | X | | X | | X | □ | X | | X | 18 |
| B′A′ | X′ | | X | A | | A′ | XX′ | B | | | X | 16 17 |
| B | | B | | A | | B | | B | | A | | 15 |
| | | B | X | B′ | X′ | B | X | | | AB | XX′ | 13 14 |
| □ | X | | X | | X | □ | X | | X | | X | 12 |
| | XX′ | B′A′ | | | X | A | X′ | A′ | X | A | | 10 11 |
| A | | B | | A | | A | | B | | A | | 9 |
| AB | X | | | A | XX′ | B′ | | B | X | | X′ | 7 8 |
| | X | | X | □ | X | | X | | X | □ | X | 6 |
| A | | A′ | XX′ | B | | | X | B′A′ | X′ | | X | 4 5 |
| A | | B | | B | | A | | B | | B | | 3 |
| B′ | X′ | B | X | | | AB | XX′ | | | B | X | 1 2 |
| 1<br>2 | 3<br>4 | 5<br>6 | 7<br>8 | 9<br>10 | 11<br>12 | 13<br>14 | 15<br>16 | 17<br>18 | 19<br>20 | 21<br>22 | 23<br>24 | |

Fig. 2

| | | | | | | | | | | | | |
|---|---|---|---|---|---|---|---|---|---|---|---|---|
| | X | □ | X | | X | | X | □ | X | | X | 36 |
| A | | A | X′ | B′A′ | | A | | A | X′ | B′A′ | | 34 35 |
| | X | | X | | X | | X | | X | | X | 33 |
| A | X′ | AB | | B | | A | X′ | AB | | B | | 31 32 |
| □ | X | | X | | X | □ | X | | X | | X | 30 |
| B | | A | | B′A′ | X′ | B | | A | | B′A′ | X′ | 28 29 |
| | X | | X | | X | | X | | X | | X | 27 |
| B | | AB | X′ | B | | B | | AB | X′ | B | | 25 26 |
| | X | | X | □ | X | | X | | X | □ | X | 24 |
| B′A′ | | A | | A | X′ | B′A′ | | A | | A | X′ | 22 23 |
| | X | | X | | X | | X | | X | | X | 21 |
| B | | A | X′ | AB | | B | | A | X′ | AB | | 19 20 |
| | X | □ | X | | X | | X | □ | X | | X | 18 |
| B′A′ | X′ | B | | A | | B′A′ | X′ | B | | A | | 16 17 |
| | X | | X | | X | | X | | X | | X | 15 |
| B | | B | | AB | X′ | B | | B | | AB | X′ | 13 14 |
| □ | X | | X | | X | □ | X | | X | | X | 12 |
| A | X′ | B′A′ | | A | | A | X′ | B′A′ | | A | | 10 11 |
| | X | | X | | X | | X | | X | | X | 9 |
| AB | | B | | A | X′ | AB | | B | | A | X′ | 7 8 |
| | X | | X | □ | X | | X | | X | □ | X | 6 |
| A | | B′A′ | X′ | B | | A | | B′A′ | X′ | B | | 4 5 |
| | X | | X | | X | | X | | X | | X | 3 |
| AB | X′ | B | | B | | AB | X′ | B | | B | | 1 2 |
| 1 | 3 | 5 | 7 | 9 | 11 | 13 | 15 | 17 | 19 | 21 | 23 | |
| 2 | 4 | 6 | 8 | 10 | 12 | 14 | 16 | 18 | 20 | 22 | 24 | |

FORMING FABRIC HAVING OFFSET BINDING WARPS

BACKGROUND OF THE INVENTION

1. Field of the Invention

The present invention relates generally to papermaking, and relates more specifically to multilayer fabrics employed in papermaking. The invention also relates to the binding of triple layer forming fabrics.

2. Discussion of Background Information

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. Both weaving methods described hereinabove are well known in the art, and the term "endless belt" as used herein refers to belts made by either method.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength, stability and life potential. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, U.S. Pat. No. 5,437,315 to Ward and U.S. Pat. No. 5,967,195 to Ward. Warp-stitched multilayer fabrics are known in the art. Examples of such fabrics are shown in U.S. Pat. No. 5,152,326 to Vohringer, U.S. Pat. No. 6,202,705 B1 to Johnson and PCT Patent No. WO 02/00996 A1.

U.S. Pat. No. 7,059,357 to WARD, the disclosure of which is hereby expressly incorporated by reference in its entirety, discloses a warp-bound triple layer forming fabric whereby the top yarn parts are vertically stacked over bottom yarns. The warp-stitched fabric is a multilayer papermaker's fabric that has a set of bottom warp yarns, a set of bottom weft yarns, a set of top weft yarns and a set of warp stitching yarn pairs. The bottom warp yarns are interwoven with the bottom weft yarns. The stitching warp yarns interweave with both the bottom weft yarns and the top weft yarns, and are woven such that at locations where the first of the stitching warp yarns in a pair weaves in the top fabric layer, the second stitching warp yarn in the pair drops below the top fabric layer to interweave with one or more bottom weft yarns to bind the top fabric layer and the bottom fabric layer together. The first stitching warp yarn of the stitching warp yarn pair may weave on a first side of one of the bottom warp yarns while the second stitching warp yarn of each stitching yarn pair may weave on the other side of that bottom warp yarn. Each stitching warp yarn pair may be substantially stacked above a bottom warp yarn. The fabric may further include a set of top warp yarns that interweave with the top weft yarns in the top fabric layer. The set of top warp yarns may be woven from a first warp beam, the set of bottom warp yarns may be woven from a second warp beam and the set of stitching warp yarns may be woven from a third warp beam. In WARD, however, only the top fabric is integrally woven. Furthermore, in WARD binding occurs only on the bottom fabric.

U.S. Pat. No. 6,860,299 to KUJI, the disclosure of which is hereby expressly incorporated by reference in its entirety, discloses an industrial multilayer textile that has at least an upper surface side layer and a lower surface side layer as a running surface. The upper surface side layer and the lower surface side layer are connected by warp ground yarn connecting yarns that weave the upper surface side layer and the lower surface side layer. Among these, a pair of warp ground yarn connecting yarns is made into yarns corresponding to one warp in an upper surface side surface, and the pair of warp ground yarn connecting yarns and another warp are alternately disposed and woven with upper surface side wefts to form a surface of a substantially plain weave texture on the upper surface side layer. However, in KUJI the locations where the pairs of crossing warps weave on the bottom are all on one side of a given bottom warp.

The use of zig-zaging binder yarns is also known. However, such a binder arrangement is used only in the context of full warp exchange fabrics whereby all warps weave on the top and the bottom alternately.

SUMMARY OF THE INVENTION

The present invention relates to warp-stitched multilayer papermaker's fabrics that employ weave patterns which can provide one or more of the following advantages: good drainage, increased join strength, reduced weaving time, increased weft yarn counts on the papermaking surface (and hence improved fiber support), and increased fabric modulus. The fabric particularly advantageously has a large number of drainage openings for causing drainage markings on the paper web. That is, the fabric has a larger number of smaller openings or holes instead of a smaller number of larger holes as in the prior art. The fabrics of the present invention are particularly useful as papermaker's forming fabrics, although the teachings of the present invention may also be advantageous in certain felt and dryer applications.

According to one non-limiting embodiment of the invention, the invention relates to a fabric of the type disclosed in WARD but which also utilizes an integrally woven bottom fabric and also bind the top fabric.

According to another non-limiting embodiment of the invention, the invention relates to a fabric of the type disclosed in KUJI except that each yarn of the crossing pair of binding yarns binds to the bottom fabric by weaving over a warp yarn, then under an adjacent yarn, and then over the next adjacent yarn of the bottom fabric before crossing back over to the top fabric.

According to another non-limiting embodiment of the present invention, there is provided a warp-stitched triple layer papermaker's fabric. The warp-stitched triple layer fabric has a set of top warp yarns woven from a first warp beam that are interwoven with a set of top weft yarns, and a set of bottom warp yarns woven from a second warp beam that are interwoven with a set of bottom weft yarns. The fabric further includes a set of binding or stitching warp yarns woven from a third warp beam that interweave with at least some of the top weft yarns and with at least some of the bottom weft yarns to bind the top fabric layer and the bottom fabric layer together. The binding or stitching warp yarns may be woven as stitching warp yarn pairs such that the two stitching warp yarns in the pair weaves, in the upper fabric, with a pattern substantially similar or the same as the adjacent non-stitching upper warp yarns and crosses to bind to the bottom fabric by weaving over a warp yarn, then under an adjacent yarn, and then over the next adjacent yarn of the bottom fabric (i.e., by weaving with three adjacent bottom weft yarns of the bottom layer once) before crossing back over to the top fabric.

According to another non-limiting embodiment of the present invention, the warp-stitched triple layer papermaker's fabric may utilize a textured over three shed reversed weave configuration.

According to another non-limiting embodiment of the present invention, the warp-stitched triple layer papermaker's fabric may utilize a plain weave on the top fabric.

According to another non-limiting embodiment of the present invention, the warp-stitched triple layer papermaker's fabric may utilize a plain over three shed reversed weave configuration.

According to another non-limiting embodiment of the present invention, the warp-stitched triple layer papermaker's fabric may utilize a textured weave on the top fabric.

According to another non-limiting embodiment of the present invention, the binding or stitching warp pair yarns are fabric-borne or intrinsic yarns.

According to another non-limiting embodiment of the present invention, the warp-stitched triple layer papermaker's fabric utilizes a larger number of drainage holes in order to break up the drainage pattern whereby drainage marking is reduced and sheet quality is improved.

According to another non-limiting embodiment of the present invention, the warp-stitched triple layer papermaker's fabric utilizes binding points on the wear side which are offset to minimize the number of holes whereby drainage marking is reduced and sheet quality is improved.

According to another non-limiting embodiment of the present invention, the warp-stitched triple layer papermaker's fabric utilizes binding yarns on the paper side which are offset, first to the left and then to the right (or vice versa) of adjacent knuckles whereby the hole geometry changes and the effective number of holes is increased. This improves sheet quality by reducing drainage marking According to another non-limiting embodiment of the present invention, the bottom warp yarns are larger than the top warp yarns, and are preferably significantly larger than the top warp yarns. The use of larger bottom warp yarns results in thicker wearside yarns and also acts to minimize the hole size and limit drainage marking.

According to another non-limiting embodiment of the present invention, the bottom warp yarns are approximately 0.27 mm in diameter and the top warp yarns are approximately 0.18 mm in diameter.

According to another non-limiting embodiment of the present invention, a size ratio of the bottom warp yarns relative to the top warp yarns is in the range of between approximately 1.5 to 1 and approximately 2 to 1, and is preferably between approximately 1.25 to 1 and approximately 2.25 to 1.

In additional aspects of the present invention, the forming fabric may include stitching yarn pairs that are substantially stacked one above the other. The top warp yarns may have a smaller diameter than the bottom warp yarns. The top weft yarns may have substantially the same diameter as the bottom weft yarns. The top weft yarns may have a smaller diameter than the bottom weft yarns. Additionally, the papermaking surface may be woven in a plain weave pattern. The machine side surface may be woven such that in each repeat unit of the fabric, each stitching warp yarn binds two alternate bottom welt yarns and pass over the weft yarn between the two alternate weft yarns. The stitching warp yarns may also be alternately arranged such that between each two non-adjacent stacked upper and lower warp yarns of the top and bottom fabrics is located a stacked pair of binding warp yarns which each weave with the top weft yarns and with the bottom weft yarns. Additionally, in embodiments, the two yarns in each pair of binding yarns may cross over six top weft yarns in each repeat of the fabric. Furthermore, in embodiments, the two yarns in each pair of binding yarns may cross over (i.e., float over) three pairs of top weft yarns in each repeat of the fabric. In embodiments, the two yarns in each pair of binding yarns may cross over (i.e., float over) three spaced apart pairs of top weft yarns in each repeat of the fabric.

The invention also provides for a forming fabric comprising a top layer comprising a plurality of first top warp yarns woven with a plurality of top weft yarns, a bottom layer comprising a plurality of first bottom warp yarns woven with a plurality of bottom weft yarns, a plurality of second top warp yarns woven with some of the plurality of top weft yarns and with some of the plurality of bottom weft yarns, a plurality of second bottom warp yarns woven with some of the plurality of top weft yarns and with some of the plurality of bottom weft yarns, at least one of the plurality of second top warp yarns weaving to the bottom layer with a short plain weave, and at least one of the plurality of second bottom warp yarns weaving to the bottom layer with a short plain weave.

The forming fabric may be a warp-stitched triple layer papermaker's fabric. The top layer may have a papermaking surface and the bottom has a machine side surface. The short plain weave may comprise at least three adjacent bottom welt yarns per repeat. The short plain weave may comprise only three adjacent bottom welt yarns per repeat. Each of the plurality of second top warp yarns and each of the plurality of second bottom warp yarns may weave to the bottom layer with a short plain weave. The at least one of the plurality of second top warp yarns and the at least one of the plurality of second bottom warp yarns may be vertically stacked one above the other. The at least one of the plurality of second top warp yarns and the at least one of the plurality of second bottom warp yarns may comprise stitching or binding warp yarns. The stitching or binding warp yarns differ from the plurality of first top and bottom warp yarns in at least one of the following characteristics: size; modulus; and material. At least one of the plurality of first top warp yarns differ from at least one of the plurality of first bottom warp yarns in at least one of the following characteristics: size; modulus; and material. The at least one of the plurality of second top warp yarns differs from the at least one of the plurality of second bottom warp yarns in at least one of the following characteristics: size; modulus; and material. The at least one of the plurality of second top warp yarns may be smaller in size than the at least one of the plurality of second bottom warp yarns. The at least one of the plurality of second top warp yarns may comprise a diameter of approximately 0.18 mm and the at least one of the plurality of second bottom warp yarns comprises a diameter of approximately 0.27 mm. A ratio of a size of the at least one of the plurality of second top warp yarns relative to the at least one of the plurality of second bottom warp yarns may be between approximately 1:1.25 to approximately 1:2.25. The ratio may be between approximately 1:1.5 to approximately 1:2. The forming fabric may have a warp ratio of between approximately 2:1 to approximately 3:2. The at least one of the plurality of second top warp yarns and the at least one of the plurality of second bottom warp yarns may comprise vertically stacked stitching or binding warp yarns of different sizes. The top layer may comprises a plain weave. The top layer may comprises a textured weave.

The invention also provide for a forming fabric comprising a top layer comprising a plurality of top warp yarns woven with a plurality of top weft yarns, a bottom layer comprising a plurality of bottom warp yarns woven with a plurality of bottom weft yarns, a plurality of first binding top warp yarns woven with some of the plurality of top weft yarns and with some of the plurality of bottom weft yarns, a plurality of second binding warp yarns woven with some of the plurality of top weft yarns and with some of the plurality of bottom weft yarns, at least one of the plurality of first binding top warp yarns weaving to the bottom layer with a short plain weave, at least one of the plurality of second binding warp yarns weaving to the bottom layer with a short plain weave, and the at least one of the plurality of first binding top warp yarns and the at least one of the plurality of second binding warp yarns being vertically stacked.

The plurality of top warp yarns and the plurality of bottom warp yarns may be vertically stacked and wherein the plurality of top weft yarns and the plurality of bottom weft yarns may be vertically stacked.

The invention also provides for a forming fabric comprising a top layer comprising a plurality of top warp yarns woven with a plurality of top weft yarns, a bottom layer comprising a plurality of bottom warp yarns woven with a plurality of bottom weft yarns, the plurality of top warp yarns and the plurality of bottom warp yarns being vertically stacked, a plurality of first binding top warp yarns woven with some of the plurality of top weft yarns and with some of the plurality of bottom weft yarns, a plurality of second binding warp yarns woven with some of the plurality of top weft yarns and with some of the plurality of bottom weft yarns, at least one of the plurality of first binding top warp yarns weaving to the bottom layer with a short plain weave, at least one of the plurality of second binding warp yarns weaving to the bottom layer with a short plain weave, and the at least one of the plurality of first binding top warp yarns and the at least one of the plurality of second binding warp yarns being vertically stacked.

The invention also provides for a method of making the fabric described above, wherein the method comprises binding or weaving together the top and bottom layers with the at least one of the plurality of first binding top warp yarns and the at least one of the plurality of second binding warp yarns.

The invention also provides for a method of making the fabric described above, wherein the method comprises binding or weaving together the top and bottom layers with the at least one of the plurality of first binding top warp yarns and the at least one of the plurality of second binding warp yarns.

Additional aspects of the present invention includes methods of manufacturing warp-stitched triple layer fabrics and methods of using the triple layer papermaker's fabric described herein for making paper.

BRIEF DESCRIPTION OF THE FIGURES

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 shows a textured weave pattern repeat of a first embodiment of the present invention;

FIG. 2 shows a plain weave pattern repeat of a second embodiment of the present invention;

DETAILED DESCRIPTION OF THE INVENTION

Figure 1A:
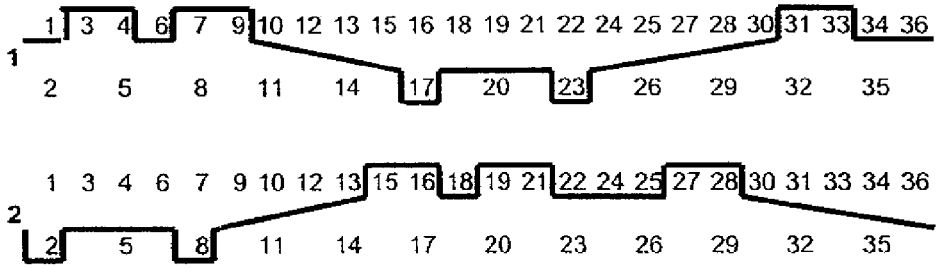
FIG. 1A shows a cross-section view of the repeat shown in FIG. 1 and illustrates upper and lower binding warp yarns 1 and 2 weaving with upper and lower fabric weft yarns 1-36.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

One aspect of the present invention is directed to "true" warp-stitched triple layer papermaker's fabrics in that they include a set of warp yarns and a set of weft yarns that only weave in the top layer of the fabric, as well as a set of warp yarns and a set of weft yarns that only weave in the bottom fabric layer. These fabrics also include stitching warp yarns that weave in both the top fabric layer and the bottom fabric layer to bind the layers together. In certain embodiments of the present invention, the binding or stitching warp yarns are provided as pairs of two stitching yarns that together replace the equivalent of a single warp yarn in the weave pattern on the papermaking surface. These yarns are woven such that when one yarn in the binding pair is weaving in the top fabric layer so as to complete the weave pattern on the papermaking surface, the second yarn in the binding pair weaves below the papermaking surface. Throughout the fabric, the yarns in each pair trade these positions. Each of these yarns in the pair also drops down to the bottom fabric layer at one point (binding with two non-adjacent bottom layer weft yarns) in each repeat so as to bind the top and bottom fabric layers together. Herein, these yarn pairs are referred to as "stitching or binding warp yarn pairs."

In certain embodiments of the invention, the "true" warp-stitched triple layer papermaker's fabrics are woven from three separate warp beams. As will be appreciated by those of skill in the art, in manufacturing papermaker's fabrics using a flat weaving process, the warp yarns are fed into the loom off of one or more warp yarn beams (or "warp beams") and the weft yarns or "picks" are "thrown" one-by-one by the loom so that they pass in the desired over/under pattern with respect to the warp yarns to weave the fabric. The tension on the yarns in each warp beam may be independently controlled, and the types of yarns provided on each beam (e.g., yarn size, modulus, filament type, etc.) may be varied. By weaving the warp-stitched fabrics of the present invention off of three separate warp beams, at least two distinct advantages may accrue.

First, by using three separate warp beams, it is possible to vary the size and/or type of yarn used for (1) the top warp yarns, (2) the bottom warp yarns and (3) the stitching warp yarns. This may be advantageous because the requirements for yarns that weave in the top layer versus the bottom layer versus both layers may differ. By way of example, in many applications, it may be desirable to use larger, sturdier warp yarns in the bottom fabric layer to provide good stretch resistance and stability. In contrast, finely woven warp yarns are often preferred on the papermaking surface as such yarns may facilitate providing a highly uniform surface that exhibits good drainage while providing a high degree of fiber support. The stitching warp yarns may have their own unique requirements. Through the use of three separate warp beams, the fabric designer can optimize the type and sizes of yarns used for the yarns that weave in different parts of the fabric. Second, the use of a separate warp beam for the top, bottom and stitching warp yarns also allows for independent tension control on each type of warp yarn. This tension control may also be used to increase the uniformity of the papermaking surface as variations in tension may impact the degree of the crimp that each type of yarn exhibits on the papermaking surface.

Pursuant to another aspect of the present invention, multi-layer warp-stitched papermaker's fabrics are provided which include stitching warp yarn pairs that are substantially stacked. This aspect of the present invention is best explained with reference to FIGS. 1A-1L and 2A-2L, which are cross-sectional views of a portion of a representative fabric that show the configuration of the warp yarns in the fabric.

Figure 1B:
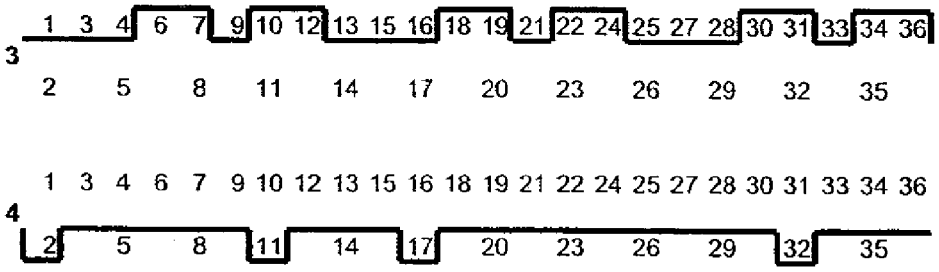
FIG. 1B shows another cross-section view of the repeat shown in FIG. 1 and illustrates upper and lower warp yarns 3 and 4 respectively weaving with upper and lower fabric weft yarns 1-36. Warp yarn 3 weaves exclusively in the top fabric layer and warp yarn 4 weaves exclusively in the bottom fabric layer.
Figure 1C:
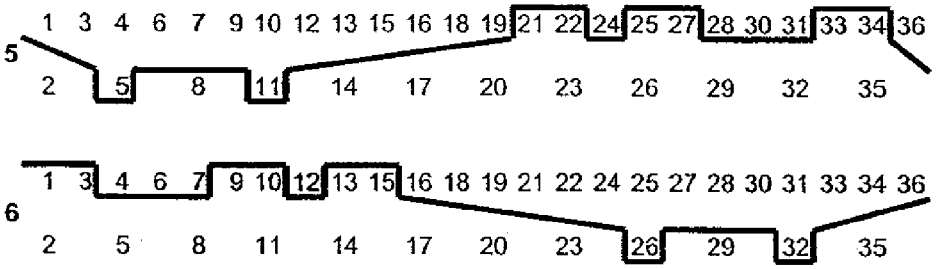
FIG. 1C shows a cross-section view of the repeat shown in FIG. 1 and illustrates other upper and lower binding warp yarns 5 and 6 weaving with upper and lower fabric weft yarns 1-36.
Figure 1D:
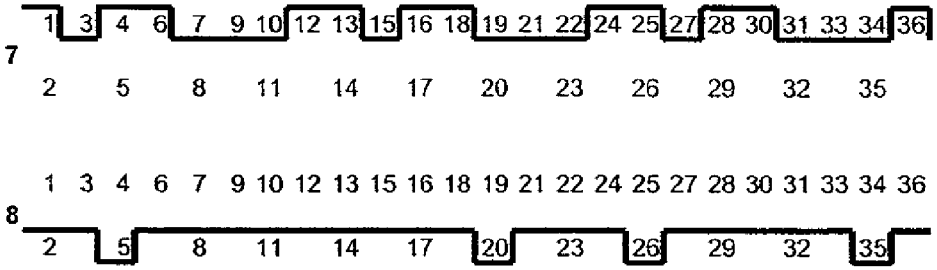
FIG. 1D shows another cross-section view of the repeat shown in FIG. 1 and illustrates upper and lower warp yarns 7 and 8 respectively weaving with upper and lower fabric weft yarns 1-36. Warp yarn 7 weaves exclusively in the top fabric layer and warp yarn 8 weaves exclusively in the bottom fabric layer.
Figure 1E:
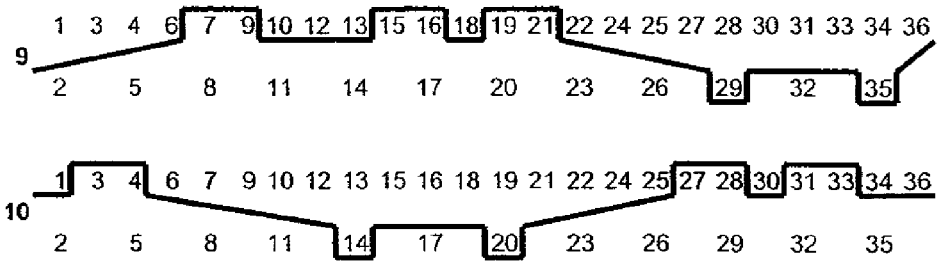
FIG. 1E shows a cross-section view of the repeat shown in FIG. 1 and illustrates other upper and lower binding warp yarns 9 and 10 weaving with upper and lower fabric weft yarns 1-36.
Figure 1F:
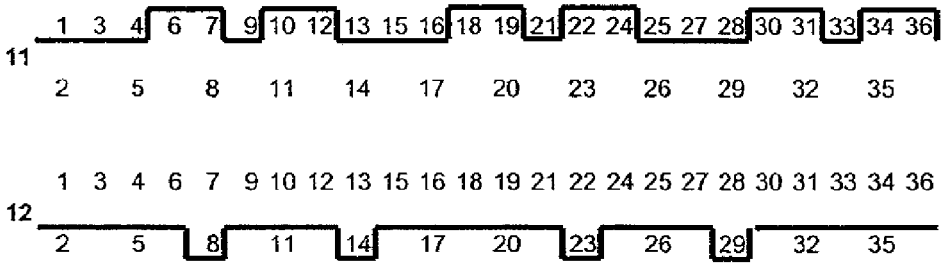
FIG. 1F shows another cross-section view of the repeat shown in FIG. 1 and illustrates upper and lower warp yarns 11 and 12 respectively weaving with upper and lower fabric weft yarns 1-36. Warp yarn 11 weaves exclusively in the top fabric layer and warp yarn 12 weaves exclusively in the bottom fabric layer.
Figure 1G:
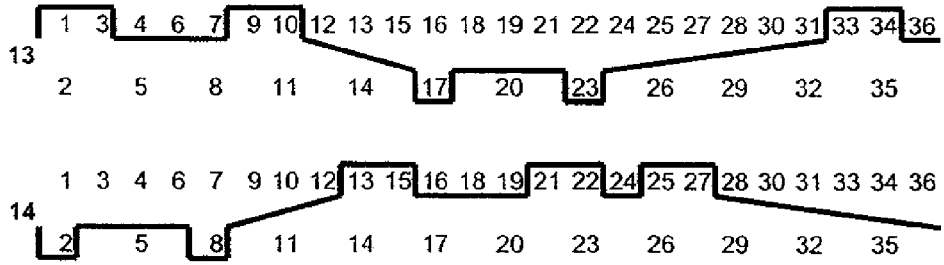
FIG. 1G shows a cross-section view of the repeat shown in FIG. 1 and illustrates other upper and lower binding warp yarns 13 and 14 weaving with upper and lower fabric weft yarns 1-36.
Figure 1H:
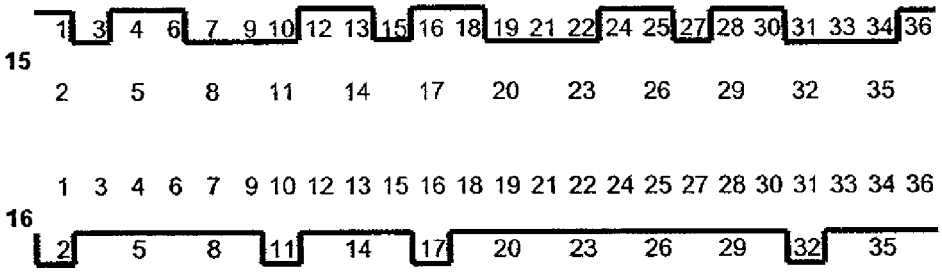
FIG. 1H shows another cross-section view of the repeat shown in FIG. 1 and illustrates upper and lower warp yarns 15 and 16 respectively weaving with upper and lower fabric weft yarns 1-36. Warp yarn 15 weaves exclusively in the top fabric layer and warp yarn 16 weaves exclusively in the bottom fabric layer.
Figure 1I:
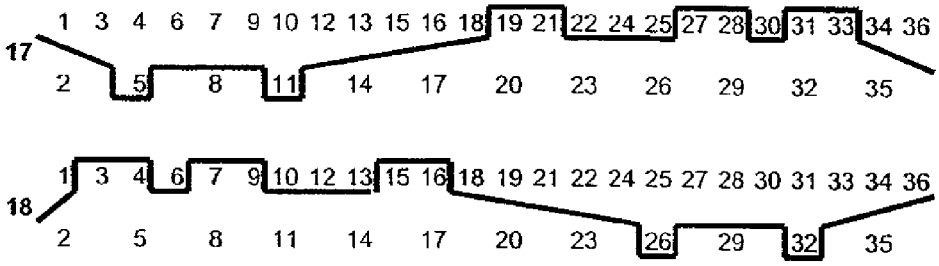
FIG. 1I shows a cross-section view of the repeat shown in FIG. 1 and illustrates other upper and lower binding warp yarns 17 and 18 weaving with upper and lower fabric weft yarns 1-36.
Figure 1J:
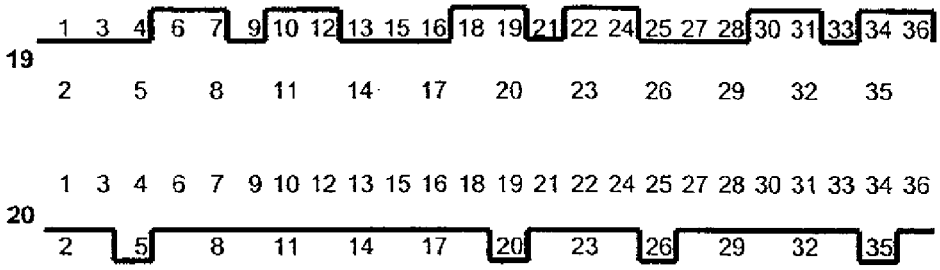
FIG. 1J shows another cross-section view of the repeat shown in FIG. 1 and illustrates upper and lower warp yarns 19 and 20 respectively weaving with upper and lower fabric weft yarns 1-36. Warp yarn 19 weaves exclusively in the top fabric layer and warp yarn 20 weaves exclusively in the bottom fabric layer.
Figure 1K:
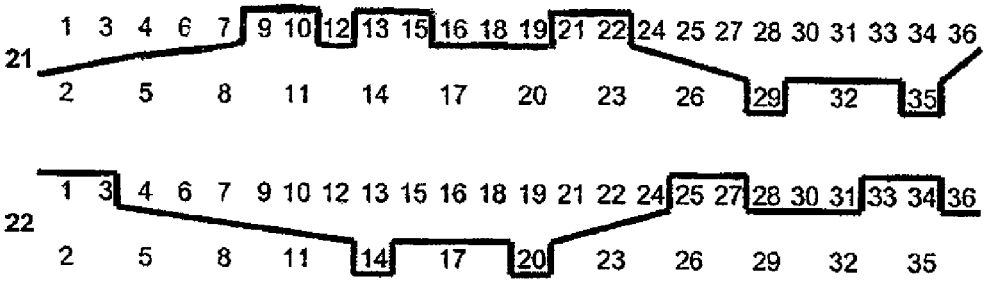
FIG. 1K shows a cross-section view of the repeat shown in FIG. 1 and illustrates other upper and lower binding warp yarns 21 and 22 weaving with upper and lower fabric weft yarns 1-36.
Figure 1L:
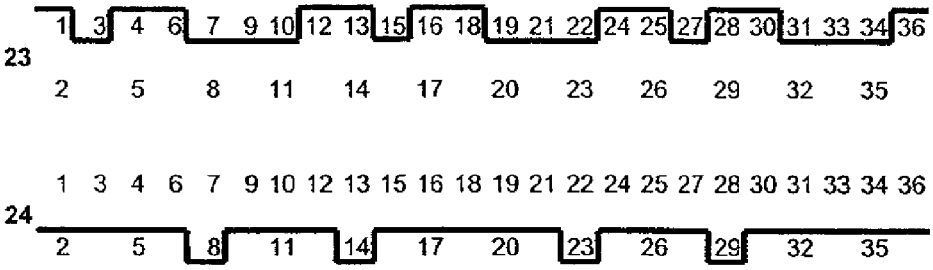
FIG. 1L shows another cross-section view of the repeat shown in FIG. 1 and illustrates upper and lower warp yarns 23 and 24 respectively weaving with upper and lower fabric weft yarns 1-36. Warp yarn 23 weaves exclusively in the top fabric layer and warp yarn 24 weaves exclusively in the bottom fabric layer.

A first non-limiting embodiment of the warp-stitched triple layer fabric of the present invention is illustrated in FIGS. 1-1L. FIG. 1 depicts a top pattern view of the top fabric layer of the triple layer fabric (i.e., a view of the papermaking surface). The numbers 1-24 shown on the bottom of the pattern identify the upper and lower warp yarns while the right side numbers 1-36 show the upper and lower weft yarns. The upper warp yarns shown on the bottom of the pattern are 1, 3, 5, 7, 9, 11, 13, 15, 17, 19, 21 and 23. The lower warp yarns shown on the bottom of the pattern are 2, 4, 6, 8, 10, 12, 14, 16, 18, 20, 22 and 24. Upper warp yarns 1, 5, 9, 13, 17 and 21 constitute the upper or first stitching or binding warp yarns and lower warp yarns 2, 6, 10, 14, 18 and 22 constitute the lower or second stitching or binding warp yarns. Upper warp yarns 3, 7, 11, 15, 19 and 23 constitute the upper warp yarns which weave exclusively with the upper layer weft yarns 1-36 and lower warp yarns 4, 8, 12, 16, 20 and 24 constitute the lower warp yarns which weave exclusively with the lower layer weft yarns 1-36. The upper weft yarns shown on the right side of the pattern are 1, 3, 4, 6, 7, 9, 10, 12, 13, 15, 16, 18, 19, 21, 22, 24, 25, 27, 28, 30, 31, 33, 34, and 36. The lower weft yarns shown on the right side of the pattern are 2, 5, 8, 11, 14, 17, 20, 23, 26, 29, 32 and 35.

Also in FIG. 1, symbol A is shown in locations where upper or first binding warp yarn passes over a top layer weft yarn. Symbol B is shown in locations where lower or second binding warp yarn passes over a top layer weft yarn. Symbol A' is shown in locations where upper or first binding warp yarn passes under a bottom layer weft yarn. Symbol B' is shown in locations where lower or second binding warp yarn passes under a bottom layer weft yarn. Symbol X is shown in locations where an exclusively upper layer warp yarn passes over an upper layer weft yarn. Symbol X' is shown in locations where a exclusively lower layer warp yarn passes under a lower layer weft yarn. Symbol O is shown in locations where an upper layer weft yarn remains uncovered by the upper and lower binding warp yarns. Symbol AB is shown in locations where the upper or first binding warp yarn passes under a top layer weft yarn and the lower or second binding warp yarn passes over a lower layer warp yarn located directly below the top layer weft yarn. Symbol B'A' is shown in locations where the upper or first binding warp yarn passes under a bottom layer weft yarn and the lower or second binding warp yarn passes over an upper layer warp yarn located directly above the bottom layer weft yarn. Symbol XX' is shown in locations where an exclusively upper layer warp yarn passes over an upper layer weft yarn and an exclusively lower layer warp yarn passes under a lower layer weft yarn FIGS. 1A-1L depict the paths of the upper and lower warp yarns 1-24 through the upper and lower weft yarns 1-36. The triple layer fabric of FIG. 1 thus shows a single repeat of the fabric that encompasses 24 warp yarns (yarns 1-24 represented vertically in the figures) and 36 weft yarns (yarns 1-36 represented horizontally in the figures). While FIGS. 1-1L only show a single repeat unit of the fabric, those of skill in the art will appreciate that in commercial applications the repeat unit shown in FIGS. 1-1L would be repeated many times, in both the warp and weft directions, to form a large fabric suitable for use on a papermaking machine.

As seen in FIG. 1A, the upper or first stitching or binding warp yarn 1 passes under upper weft yarn 1, then floats over upper weft yarns 3 and 4, then passes beneath upper weft yarn 6, then floats over upper weft yarns 7 and 9. Thereafter, the upper or first stitching or binding warp yarn 1 crosses to the lower layer by passing underneath upper weft yarns 10, 12, 13 and 15 before weaving with lower weft yarns 17, 20 and 23. That is, the upper or first stitching or binding warp yarn 1 weaves with lower weft yarns 17, 20 and 23 by first passing under lower weft yarn 17, then passing above adjacent lower weft yarn 20, and then passing under lower weft yarn 23. Thus, in the area where the upper or first stitching or binding warp yarn 1 weaves with the lower layer, the binding of the lower layer occurs with a weave instead of with a single binding point as is the case in U.S. Pat. No. 7,059,357 to WARD. Furthermore, the weave of upper binding yarn 1 with lower weft yarns 17, 20 and 23 is a short plain weave. Thereafter, the upper or first stitching or binding warp yarn 1 crosses back over to the upper layer by passing underneath upper weft yarns 24, 25, 27, 28 and 30 before again weaving with other upper weft yarns. The upper or first stitching or binding warp yarn 1 passes over upper weft yarn 31, then floats over upper weft yarns 31 and 33, then passes beneath upper weft yarns 34 and 36.

Also seen in FIG. 1A, the lower or second stitching or binding warp yarn 2 passes under lower weft yarn 2, then over lower weft yarn 5, then passes under lower weft yarn 8. Thus, in the area where the lower or second stitching or binding warp yarn 2 weaves with the lower layer, the binding of the lower layer occurs with a weave instead of with a single binding point. Thereafter, the lower or second stitching or binding warp yarn 2 crosses to the upper layer by passing underneath upper weft yarns 9, 10, 12 and 13 before weaving with upper weft yarns. That is, the lower or second stitching or binding warp yarn 2 weaves with upper weft yarns by first passing or floating over upper weft yarns 15 and 16, then passing beneath adjacent upper weft yarn 18, and then passing or floating over upper weft yarns 19 and 21. Then, the lower or second binding yarn 2 passes under upper weft yarns 22, 24 and 25, before passing or floating over upper weft yarns 27 and 28. Thereafter, the lower or second stitching or binding warp yarn 2 crosses back over to the bottom layer by passing underneath upper weft yarns 30, 31, 33, 34, and 36, before again weaving with other lower weft yarns in another pattern repeat.

As seen in FIG. 1B, the next adjacent upper warp yarn 3 is not a stitching or binding warp yarn and instead weaves exclusively with the top layer weft yarns 1, 3, 4, 6, 7, 9, 10, 12, 13, 15, 16, 18, 19, 21, 22, 24, 25, 27, 28, 30, 31, 33, 34 and 36 to form a textured pattern which follows the following course: upper warp yarn 3 passes under upper weft yarns 1, 3, and 4, then floats over upper weft yarns 6 and 7, then passes beneath upper weft yarn 9, then floats over upper weft yarns 10 and 12. Thereafter, the upper warp yarn 3 passes underneath upper weft yarns 13, 15, and 16 before passing or floating over upper weft yarns 18 and 19. Upper warp yarn 3 then passes under upper weft yarn 21, then floats over upper weft yarns 22 and 24, then passes beneath upper weft yarns 25, 27 and 28, then floats over upper weft yarns 30 and 31. Thereafter, the upper warp yarn 3 passes underneath upper weft yarn 33 before passing or floating over upper weft yarns 34 and 36.

Also seen in FIG. 1B, the next adjacent lower warp yarn 4 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 4 passes under lower weft yarn 2, then passes over lower weft yarns 5 and 8, then passes under lower weft yarn 11, then passes over lower weft yarn 14. Thereafter, the lower warp yarn 4 passes under lower weft yarn 17 before passing over lower weft yarns 20, 23, 26 and 29. Lower warp yarn 4 then passes under lower weft yarn 32, then over lower weft yarn 35.

As seen in FIG. 1C, the next adjacent yarn is another upper or first stitching or binding warp yarn 5 and passes under upper weft yarns 1 and 3, then passes under lower weft yarn 5, then passes above lower weft yarn 8, then under lower weft yarn 11. Thus, in the area where the upper or first stitching or binding warp yarn 5 weaves with the lower layer, the binding of the lower layer occurs with a weave instead of with a single binding point as is the case in U.S. Pat. No. 7,059,357 to WARD. Furthermore, the weave of upper binding yarn 5 with lower weft yarns 5, 8 and 11 is a short plain weave. Thereafter, the upper or first stitching or binding warp yarn 5 crosses to the upper layer by passing underneath upper weft yarns 12, 13, 15, 16, 18 and 19 before weaving with upper weft yarns. That is, the upper binding warp yarn 5 first passes or floats over upper weft yarns 21 and 22, then passes beneath adjacent upper weft yarn 24, and then passes or floats over upper weft yarns 25 and 27. Thereafter, the upper or first stitching or binding warp yarn 5 passes underneath upper weft yarns 28, 30 and 31 before passing or floating over upper weft yarns 33 and 34. The upper or first stitching or binding warp yarn 5 then crosses to the lower layer after first passing beneath upper weft yarn 36.

Also seen in FIG. 1C, the lower or second stitching or binding warp yarn 6 passes over upper weft yarns 1 and 3, then under upper weft yarns 4, 6 and 7, then passes or floats over upper weft yarns 9 and 10. Then, the lower or second stitching or binding warp yarn 6 passes under upper weft yarn 12, then passes or floats over upper weft yarns 13 and 15. Thereafter, the lower or second stitching or binding warp yarn 6 crosses to the lower layer by passing underneath upper weft yarns 16, 18, 19, 21, 22 and 24 before weaving with lower weft yarns 26, 29 and 32. Thus, in the area where the lower or second stitching or binding warp yarn 6 weaves with the lower layer, the binding of the lower layer occurs with a weave instead of with a single binding point. Then, the lower or second stitching or binding warp yarn 6 crosses back to the upper layer by first passing underneath upper weft yarns 33, 34, and 36, before again weaving with other upper weft yarns in another pattern repeat.

As seen in FIG. 1D, the next adjacent upper warp yarn 7 is not a stitching or binding warp yarn and instead weaves exclusively with the top layer weft yarns 1, 3, 4, 6, 7, 9, 10, 12, 13, 15, 16, 18, 19, 21, 22, 24, 25, 27, 28, 30, 31, 33, 34 and 36 to form a textured pattern which follows the following course: upper warp yarn 7 passes over upper weft yarn 1, then under upper weft yarn 3, and then floats over upper weft yarns 4 and 6, then passes beneath upper weft yarns 7, 9 and 10, then floats over upper weft yarns 12 and 13. Thereafter, the upper warp yarn 7 passes underneath upper weft yarn 15 before passing or floating over upper weft yarns 16 and 18. Upper warp yarn 7 then passes under upper weft yarns 19, 21 and 22, then floats over upper weft yarns 24 and 25, then passes beneath upper weft yarn 27, then floats over upper weft yarns 28 and 30. Thereafter, the upper warp yarn 7 passes underneath upper weft yarns 31, 33 and 34 before passing over upper weft yarn 36.

Also seen in FIG. 1D, the next adjacent lower warp yarn 8 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 8 passes over lower weft yarn 2, then passes under lower weft yarn 5, then passes over lower weft yarns 8, 11, 14 and 17, then passes under lower weft yarn 20. Thereafter, the lower warp yarn 8 passes over lower weft yarn 23 before passing under lower weft yarn 26. Lower warp yarn 8 then passes over lower weft yarns 29 and 32, then under lower weft yarn 35.

As seen in FIG. 1E, the next upper or first stitching or binding warp yarn 9 passes under upper weft yarns 1, 3, 4 and 6, then floats over upper weft yarns 7 and 9, then passes beneath upper weft yarns 10, 12 and 13, then floats over upper weft yarns 15 and 16. The upper or first stitching or binding warp yarn 9 then passes under upper weft yarn 18, then floats over upper weft yarns 19 and 21. Thereafter, the upper or first stitching or binding warp yarn 9 crosses to the lower layer by passing underneath upper weft yarns 22, 24, 25 and 27 before weaving with lower weft yarns 29, 32 and 35. That is, the upper or first stitching or binding warp yarn 9 weaves with lower weft yarns 29, 32 and 35 by first passing under lower weft yarn 29, then passing above adjacent lower weft yarn 32, and then passing under lower weft yarn 35. Thus, in the area where the upper or first stitching or binding warp yarn 9 weaves with the lower layer, the binding of the lower layer occurs with a weave instead of with a single binding point as is the case in U.S. Pat. No. 7,059,357 to WARD. Furthermore, the weave of upper binding yarn 9 with lower weft yarns 29, 32 and 35 is a short plain weave. Thereafter, the upper or first stitching or binding warp yarn 9 crosses back over to the upper layer by passing underneath upper weft yarn 36 before again weaving with other upper weft yarns in another pattern repeat.

Also seen in FIG. 1E, the lower or second stitching or binding warp yarn 10 passes under upper weft yarn 1, then passes or floats over upper weft yarns 3 and 4. Thereafter, the lower or second stitching or binding warp yarn 10 crosses to the lower layer by passing underneath upper weft yarns 6, 7, 9, 10 and 12 before weaving with lower weft yarns 14, 17 and 20. That is, the lower or second stitching or binding warp yarn 10 weaves with lower weft yarns 14, 17 and 20 by first passing under lower weft yarn 14, then passing above adjacent lower weft yarn 17, and then passing under lower weft yarn 20. Thus, in the area where the lower or second stitching or binding warp yarn 10 weaves with the lower layer, the binding of the lower layer occurs with a weave instead of with a single binding point. Thereafter, the lower or second stitching or binding warp yarn 10 crosses back over to the upper layer by passing underneath upper weft yarns 21, 22, 24 and 25, before again weaving with the upper weft yarns. Here, the lower or second stitching or binding warp yarn 10 passes or floats over upper weft yarns 27 and 28. Thereafter, the lower or second stitching or binding warp yarn 10 passes under upper weft yarn 30 before passing or floating over upper weft yarns 31 and 33. Then, the lower or second stitching or binding warp yarn 10 passes under upper weft yarns 34 and 36.

As seen in FIG. 1F, the next adjacent upper warp yarn 11 is not a stitching or binding warp yarn and instead weaves exclusively with the top layer weft yarns 1, 3, 4, 6, 7, 9, 10, 12, 13, 15, 16, 18, 19, 21, 22, 24, 25, 27, 28, 30, 31, 33, 34 and 36 to form a textured pattern which follows the following course: upper warp yarn 11 passes under upper weft yarns 1, 3, and 4, then floats over upper weft yarns 6 and 7, then passes beneath upper weft yarn 9, then floats over upper weft yarns 10 and 12. Thereafter, the upper warp yarn 11 passes underneath upper weft yarns 13, 15, and 16 before passing or floating over upper weft yarns 18 and 19. Upper warp yarn 11 then passes under upper weft yarn 21, then floats over upper weft yarns 22 and 24, then passes beneath upper weft yarns 25, 27 and 28, then floats over upper weft yarns 30 and 31. Thereafter, the upper warp yarn 11 passes underneath upper weft yarn 33 before passing or floating over upper weft yarns 34 and 36.

Also seen in FIG. 1F, the next adjacent lower warp yarn 12 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 12 passes over lower weft yarns 2 and 5, then passes under lower weft yarn 8, then passes over lower weft yarn 11, then passes under lower weft yarn 14. Thereafter, the lower warp yarn 11 passes over lower weft yarns 17 and 20 before passing under lower weft yarn 23. Lower warp yarn 12 then passes over lower weft yarn 26, then under lower weft yarn 29. Lower warp yarn 12 then passes over lower weft yarns 32 and 35.

As seen in FIG. 1G, the next adjacent yarn is another upper or first stitching or binding warp yarn 13 and passes over upper weft yarns 1 and 3, then passes under upper weft yarns 4, 6 and 7, then passes or floats over upper weft yarns 9 and 10. Thereafter, the upper or first stitching or binding warp yarn 13 crosses to the lower layer by passing underneath upper weft yarns 12, 13 and 15 before weaving with lower weft yarns 17, 20 and 23. Thus, in the area where the upper or first stitching or binding warp yarn 13 weaves with the lower layer, the binding of the lower layer occurs with a weave instead of with a single binding point as is the case in U.S. Pat. No. 7,059,357 to WARD. Furthermore, the weave of upper binding yarn 13 with lower weft yarns 17, 20 and 23 is a short plain weave. Thereafter, the upper or first stitching or binding warp yarn 13 crosses to the upper layer by passing underneath upper weft yarns 24, 25, 27, 28, 30 and 31 before weaving with upper weft yarns. The upper or first stitching or binding warp yarn 13 then passes or floats over upper weft yarns 33 and 34, and then passes under upper weft yarn 36.

Also seen in FIG. 1G, the lower or second stitching or binding warp yarn 14 passes under lower weft yarn 2, then over lower weft yarn 5, then passes under lower weft yarn 8. Thereafter, the lower or second stitching or binding warp yarn 14 crosses to the upper layer by passing underneath upper weft yarns 9, 10 and 12. The lower or second stitching or binding warp yarn 14 then passes or floats over upper weft yarns 13 and 15, and then passes under upper weft yarns 16, 18 and 19. Then, the lower or second stitching or binding warp yarn 14 passes or floats over upper weft yarns 21 and 22, and then passes under upper weft yarn 24, and then passes or floats over upper weft yarns 25 and 27. Thereafter, the lower or second stitching or binding warp yarn 14 crosses to the lower layer by passing underneath upper weft yarns 28, 30, 31, 33, 34 and 36.

As seen in FIG. 1H, the next adjacent upper warp yarn 15 is not a stitching or binding warp yarn and instead weaves exclusively with the top layer weft yarns 1, 3, 4, 6, 7, 9, 10, 12, 13, 15, 16, 18, 19, 21, 22, 24, 25, 27, 28, 30, 31, 33, 34 and 36 to form a textured pattern which follows the following course: upper warp yarn 15 passes over upper weft yarn 1, then under upper weft yarn 3, and then floats over upper weft yarns 4 and 6, then passes beneath upper weft yarns 7, 9 and 10, then floats over upper weft yarns 12 and 13. Thereafter, the upper warp yarn 15 passes underneath upper weft yarn 15 before passing or floating over upper weft yarns 16 and 18. Upper warp yarn 15 then passes under upper weft yarns 19, 21 and 22, then floats over upper weft yarns 24 and 25, then passes beneath upper weft yarn 27, and then floats over upper weft yarns 28 and 30. Thereafter, the upper warp yarn 15 passes underneath upper weft yarns 31, 33 and 34 before passing over upper weft yarn 36.

Also seen in FIG. 1H, the next adjacent lower warp yarn 16 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 16 passes under lower weft yarn 2, then passes over lower weft yarns 5 and 8, then passes under lower weft yarn 11, then passes over lower weft yarn 14. Thereafter, the lower warp yarn 16 passes under lower weft yarn 17 before passing over lower weft yarns 20, 23, 26 and 29. Lower warp yarn 16 then passes under lower weft yarn 32, then over lower weft yarn 35.

As seen in FIG. 1I, the next adjacent yarn is another upper or first stitching or binding warp yarn 17 and passes under upper weft yarns 1 and 3, then passes under lower weft yarn 5, then passes above lower weft yarn 8, then under lower weft yarn 11. Thus, in the area where the upper or first stitching or binding warp yarn 17 weaves with the lower layer, the binding of the lower layer occurs with a weave instead of with a single binding point as is the case in U.S. Pat. No. 7,059,357 to WARD. Furthermore, the weave of upper binding yarn 17 with lower weft yarns 5, 8 and 11 is a short plain weave. Thereafter, the upper or first stitching or binding warp yarn 17 crosses to the upper layer by passing underneath upper weft yarns 12, 13, 15, 16 and 18 before weaving with upper weft yarns. Then, the upper binding warp yarn 17 passes or floats over upper weft yarns 19 and 21, then passes beneath adjacent upper weft yarns 22, 24 and 25, and then passes or floats over upper weft yarns 27 and 28. Thereafter, the upper or first stitching or binding warp yarn 17 passes underneath upper weft yarn 30 before passing or floating over upper weft yarns 31 and 33. The upper or first stitching or binding warp yarn 17 then crosses to the lower layer after first passing beneath upper weft yarns 34 and 36.

Also seen in FIG. 1I, the lower or second stitching or binding warp yarn 18 passes under upper weft yarn 1, then passes or floats over upper weft yarns 3 and 4, then passes under upper weft yarn 6. Then, the lower or second stitching or binding warp yarn 18 passes or floats over upper weft yarns 7 and 9, then passes under upper weft yarns 10, 12 and 13. Thereafter, the lower or second stitching or binding warp yarn 18 passes or floats over upper weft yarns 15 and 16 before crossing to the lower layer by passing underneath upper weft yarns 18, 19, 21, 22 and 24. Then, the lower or second stitching or binding warp yarn 18 weaves with lower weft yarns 26, 29 and 32. Thus, in the area where the lower or second stitching or binding warp yarn 18 weaves with the lower layer, the binding of the lower layer occurs with a weave instead of with a single binding point. Then, the lower or second stitching or binding warp yarn 18 crosses back to the upper layer by first passing underneath upper weft yarns 33, 34, and 36, before again weaving with other upper weft yarns in another pattern repeat.

As seen in FIG. 1J, the next adjacent upper warp yarn 19 is not a stitching or binding warp yarn and instead weaves exclusively with the top layer weft yarns 1, 3, 4, 6, 7, 9, 10, 12, 13, 15, 16, 18, 19, 21, 22, 24, 25, 27, 28, 30, 31, 33, 34 and 36 to form a textured pattern which follows the following course: upper warp yarn 19 passes under upper weft yarns 1, 3, and 4, then floats over upper weft yarns 6 and 7, then passes beneath upper weft yarn 9, then floats over upper weft yarns 10 and 12. Thereafter, the upper warp yarn 19 passes underneath upper weft yarns 13, 15, and 16 before passing or floating over upper weft yarns 18 and 19. Upper warp yarn 19 then passes under upper weft yarn 21, then floats over upper weft yarns 22 and 24, then passes beneath upper weft yarns 25, 27 and 28, then floats over upper weft yarns 30 and 31. Thereafter, the upper warp yarn 19 passes underneath upper weft yarn 33 before passing or floating over upper weft yarns 34 and 36.

Also seen in FIG. 1J, the next adjacent lower warp yarn 20 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 20 passes over lower weft yarn 2, then passes under lower weft yarn 5, then passes over lower weft yarns 8, 11, 14 and 17, and then passes under lower weft yarn 20. Thereafter, the lower warp yarn 20 passes over lower weft yarn 23 before passing under lower weft yarn 26. Lower warp yarn 20 then passes over lower weft yarns 29 and 32, then under lower weft yarn 35.

As seen in FIG. 1K, the next upper or first stitching or binding warp yarn 21 passes under upper weft yarns 1, 3, 4, 6 and 7, then passes over upper weft yarns 9 and 10, then under upper weft yarn 12. Then binding warp yarn 21 passes over upper weft yarns 13 and 15, then under upper weft yarns 16, 18 and 19, and then over upper weft yarns 21 and 22. Thereafter, the upper or first stitching or binding warp yarn 21 crosses to the lower layer by passing underneath upper weft yarns 24, 25 and 27 before weaving with lower weft yarns 29, 32 and 35. That is, the upper or first stitching or binding warp yarn 21 weaves with lower weft yarns 29, 32 and 35 by first passing under lower weft yarn 29, then passing above adjacent lower weft yarn 32, and then passing under lower weft yarn 35. Thus, in the area where the upper or first stitching or binding warp yarn 21 weaves with the lower layer, the binding of the lower layer occurs with a weave instead of with a single binding point as is the case in U.S. Pat. No. 7,059,357 to WARD. Furthermore, the weave of upper binding yarn 21 with lower weft yarns 29, 32 and 35 is a short plain weave. Thereafter, the upper or first stitching or binding warp yarn 21 crosses back over to the upper layer by passing underneath upper weft yarn 36 before again weaving with other upper weft yarns in another pattern repeat.

Also seen in FIG. 1K, the lower or second stitching or binding warp yarn 22 passes over upper weft yarns 1 and 3. Thereafter, the lower or second stitching or binding warp yarn 22 crosses to the lower layer by passing underneath upper weft yarns 4, 6, 7, 9, 10 and 12 before weaving with lower weft yarns 14, 17 and 20. That is, the lower or second stitching or binding warp yarn 22 weaves with lower weft yarns 14, 17 and 20 by first passing under lower weft yarn 14, then passing above adjacent lower weft yarn 17, and then passing under lower weft yarn 20. Thus, in the area where the lower or second stitching or binding warp yarn 22 weaves with the lower layer, the binding of the lower layer occurs with a weave instead of with a single binding point. Thereafter, the lower or second stitching or binding warp yarn 22 crosses back over to the upper layer by passing underneath upper weft yarns 21, 22 and 24, before again weaving with the upper weft yarns. Here, the lower or second stitching or binding warp yarn 22 passes or floats over upper weft yarns 25 and 27. Thereafter, the lower or second stitching or binding warp yarn 22 passes under upper weft yarns 28, 30 and 31 before passing or floating over upper weft yarns 33 and 34. Then, the lower or second stitching or binding warp yarn 22 passes under upper weft yarn 36.

As seen in FIG. 1L, the next adjacent upper warp yarn 23 is not a stitching or binding warp yarn and instead weaves exclusively with the top layer weft yarns 1, 3, 4, 6, 7, 9, 10, 12, 13, 15, 16, 18, 19, 21, 22, 24, 25, 27, 28, 30, 31, 33, 34 and 36 to form a textured pattern which follows the following course; upper warp yarn 23 passes over upper weft yarn 1, then under upper weft yarn 3, and then floats over upper weft yarns 4 and 6, then passes beneath upper weft yarns 7, 9 and 10, then floats over upper weft yarns 12 and 13. Thereafter, the upper warp yarn 15 passes underneath upper weft yarn 15 before passing or floating over upper weft yarns 16 and 18. Upper warp yarn 23 then passes under upper weft yarns 19, 21 and 22, then floats over upper weft yarns 24 and 25, then passes beneath upper weft yarn 27, and then floats over upper weft yarns 28 and 30. Thereafter, the upper warp yarn 23 passes underneath upper weft yarns 31, 33 and 34 before passing over upper weft yarn 36.

Also seen in FIG. 1L, the next adjacent lower warp yarn 24 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 24 passes over lower weft yarns 2 and 5, then passes under lower weft yarn 8, then passes over lower weft yarn 11, then passes under lower weft yarn 14. Thereafter, the lower warp yarn 24 passes over lower weft yarns 17 and 20 before passing under lower weft yarn 23. Lower warp yarn 24 then passes over lower weft yarn 26, then under lower weft yarn 29. Then, the lower warp yarn 24 passes over lower weft yarns 32 and 35.

By way of non-limiting example, the top layer weft yarns 1, 3, 4, 6, 7, 9, 10, 12, 13, 15, 16, 18, 19, 21, 22, 24, 25, 27, 28, 30, 31, 33, 34 and 36 of the embodiment shown in FIGS. 1-1L can have the following characteristics: acceptable size range of between approximately 0.10 mm and approximately 0.30 mm, preferable size ranges of between approximately 0.15 mm and approximately 0.25 mm, and most preferred size range of between approximately 0.18 mm and approximately 0.22 mm. The material for these yarns can be any natural or synthetic material, is preferably a synthetic monofilament, and is most preferably a polyester monofilament.

By way of non-limiting example, the bottom layer weft yarns 2, 5, 8, 11, 14, 17, 20, 23, 26, 29, 32 and 35 of the embodiment shown in FIGS. 1-1L can have the following characteristics: acceptable size range of between approximately 0.20 mm and approximately 0.40 mm, preferable size ranges of between approximately 0.25 mm and approximately 0.35 mm, and most preferred size range of between approximately 0.28 mm and approximately 0.32 mm. The material for these yarns can be any natural or synthetic material, is preferably a synthetic monofilament, and is most preferably a polyester monofilament. The bottom weft yarns can preferably be constructed using relatively large diameter yarns that are well suited to sustain the wear caused by the friction between the machine side surface of the fabric and the papermaking machine during use of the fabric.

By way of non-limiting example, the upper warp yarns 1, 3, 5, 7, 9, 11, 13, 15, 17, 19, 21 and 23 of the embodiment shown in FIGS. 1-1L can have the following characteristics: acceptable size range of between approximately 0.10 mm and approximately 0.30 mm, preferable size ranges of between approximately 0.15 mm and approximately 0.25 mm, and most preferred size range of between approximately 0.18 mm and approximately 0.22 mm. The material for these yarns can be any natural or synthetic material, is preferably a synthetic monofilament, and is most preferably a polyester monofilament.

By way of non-limiting example, the lower warp yarns 2, 4, 6, 8, 10, 12, 14, 16, 18, 20, 22 and 24 of the embodiment shown in FIGS. 1-1L can have the following characteristics: acceptable size range of between approximately 0.20 mm and approximately 0.40 mm, preferable size ranges of between approximately 0.25 mm and approximately 0.35 mm, and most preferred size range of between approximately 0.28 mm and approximately 0.32 mm. The material for these yarns can be any natural or synthetic material, is preferably a synthetic monofilament, and is most preferably a polyester monofilament. These bottom warp yarns may also be constructed using larger diameter yarns than the upper warp yarns.

In the embodiment shown in FIGS. 1-1L, only 50% of the warp yarns (i.e., 12 out of the 24 warp yarns in each repeat of the fabric) weave in both the top fabric layer and the bottom fabric layer. As a result of this configuration, improved "stacking" of the yarns running in the warp direction may be obtained. The stacked warp yarn arrangement of fabric can provide straight-through drainage—a desired fabric feature in many papermaking applications—as water reaching the top surface of the top fabric layer meets relatively small drainage holes between the yarns that go straight through to the bottom of the bottom fabric layer. Additionally, by having less than 100% of the warp yarns weaving in both the top and bottom fabric layers, it is generally possible to reduce the yarn mass within the fabric, thereby providing a fabric having increased permeability and a higher void volume than an equivalent fabric formed with 100% of the warp yarns configured as stitching yarns. These features are also desirable in numerous papermaking applications.

Figure 2A:
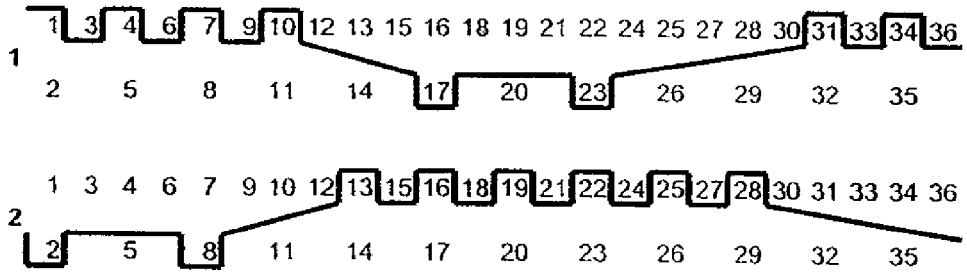
FIG. 2A shows a cross-section view of the repeat shown in FIG. 2 and illustrates upper and lower binding warp yarns 1 and 2 weaving with upper and lower fabric weft yarns 1-36.
Figure 2B:
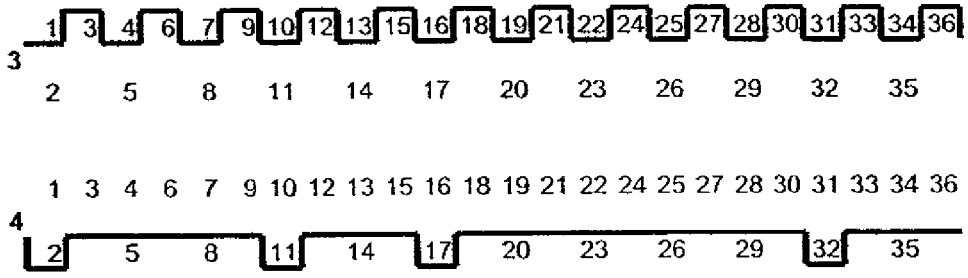
FIG. 2B shows another cross-section view of the repeat shown in FIG. 2 and illustrates upper and lower warp yarns 3 and 4 respectively weaving with upper and lower fabric weft yarns 1-36. Warp yarn 3 weaves exclusively in the top fabric layer and warp yarn 4 weaves exclusively in the bottom fabric layer.
Figure 2C:
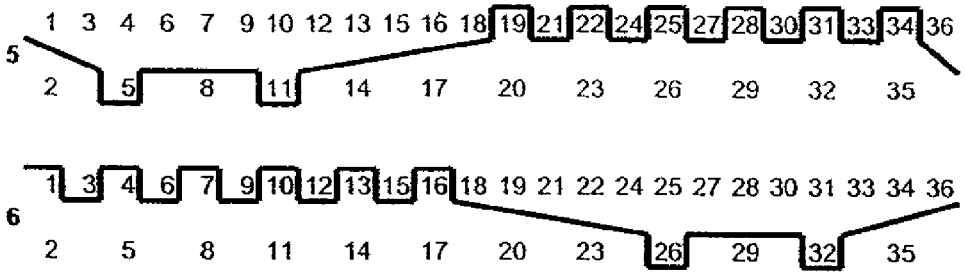
FIG. 2C shows a cross-section view of the repeat shown in FIG. 2 and illustrates other upper and lower binding warp yarns 5 and 6 weaving with upper and lower fabric weft yarns 1-36.
Figure 2D:
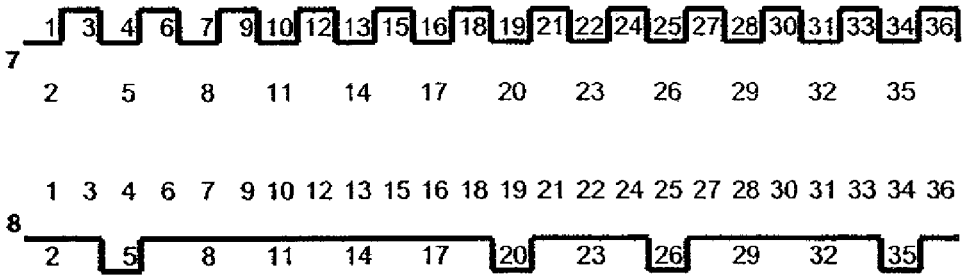
FIG. 2D shows another cross-section view of the repeat shown in FIG. 2 and illustrates upper and lower warp yarns 7 and 8 respectively weaving with upper and lower fabric weft yarns 1-36. Warp yarn 7 weaves exclusively in the top fabric layer and warp yarn 8 weaves exclusively in the bottom fabric layer.
Figure 2E:
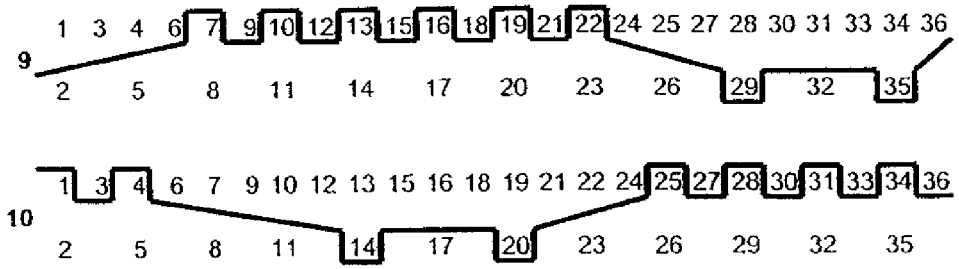
FIG. 2E shows a cross-section view of the repeat shown in FIG. 2 and illustrates other upper and lower binding warp yarns 9 and 10 weaving with upper and lower fabric weft yarns 1-36.
Figure 2F:
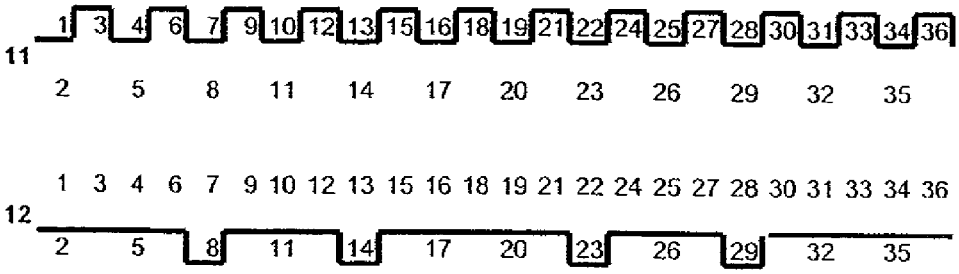
FIG. 2F shows another cross-section view of the repeat shown in FIG. 2 and illustrates upper and lower warp yarns 11 and 12 respectively weaving with upper and lower fabric weft yarns 1-36. Warp yarn 11 weaves exclusively in the top fabric layer and warp yarn 12 weaves exclusively in the bottom fabric layer.
Figure 2G:
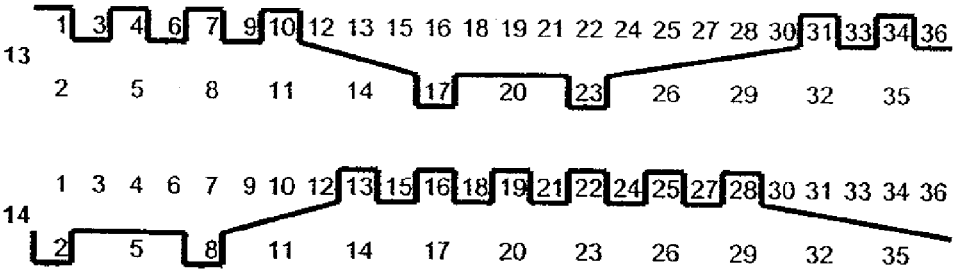
FIG. 2G shows a cross-section view of the repeat shown in FIG. 2 and illustrates other upper and lower binding warp yarns 13 and 14 weaving with upper and lower fabric weft yarns 1-36.
Figure 2H:
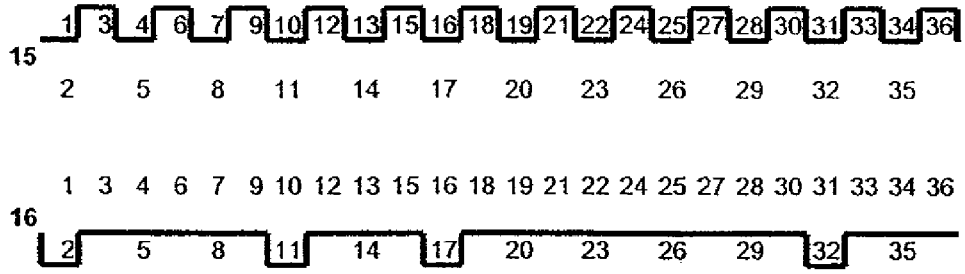
FIG. 2H shows another cross-section view of the repeat shown in FIG. 2 and illustrates upper and lower warp yarns 15 and 16 respectively weaving with upper and lower fabric weft yarns 1-36. Warp yarn 15 weaves exclusively in the top fabric layer and warp yarn 16 weaves exclusively in the bottom fabric layer.
Figure 2I:
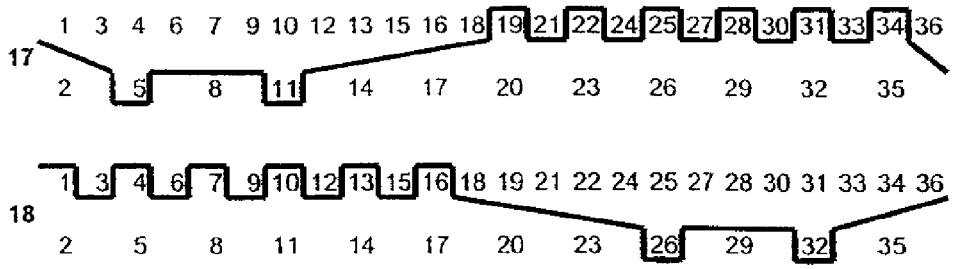
FIG. 2I shows a cross-section view of the repeat shown in FIG. 2 and illustrates other upper and lower binding warp yarns 17 and 18 weaving with upper and lower fabric weft yarns 1-36.
Figure 2J:
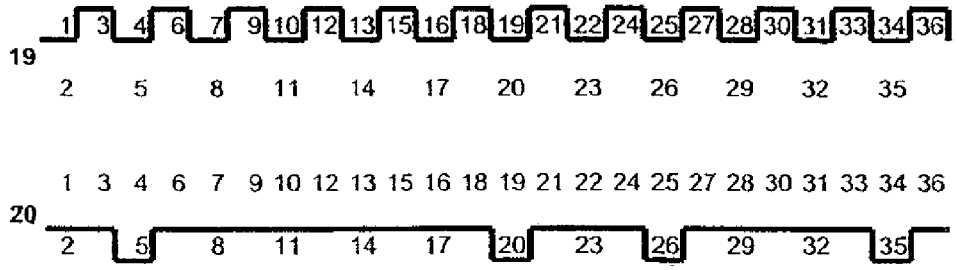
FIG. 2J shows another cross-section view of the repeat shown in FIG. 2 and illustrates upper and lower warp yarns 19 and 20 respectively weaving with upper and lower fabric weft yarns 1-36. Warp yarn 19 weaves exclusively in the top fabric layer and warp yarn 20 weaves exclusively in the bottom fabric layer.
Figure 2K:
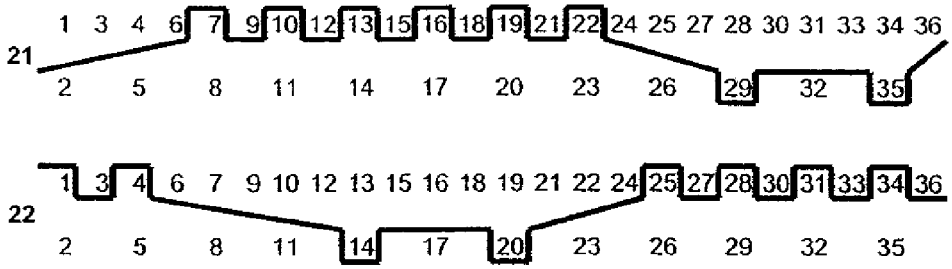
FIG. 2K shows a cross-section view of the repeat shown in FIG. 2 and illustrates other upper and lower binding warp yarns 21 and 22 weaving with upper and lower fabric weft yarns 1-36.
Figure 2L:
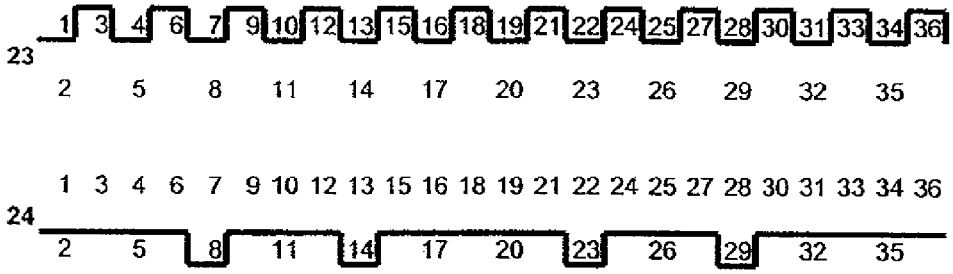
FIG. 2L shows another cross-section view of the repeat shown in FIG. 2 and illustrates upper and lower warp yarns 23 and 24 respectively weaving with upper and lower fabric weft yarns 1-36. Warp yarn 23 weaves exclusively in the top fabric layer and warp yarn 24 weaves exclusively in the bottom fabric layer.

A second non-limiting embodiment of the warp-stitched triple layer fabric of the present invention is illustrated in FIGS. 2-2L. FIG. 2 depicts a top pattern view of the top fabric layer of the triple layer fabric (i.e., a view of the papermaking surface). The numbers 1-24 shown on the bottom of the pattern identify the upper and lower warp yarns while the right side numbers 1-36 show the upper and lower weft yarns. The upper warp yarns shown on the bottom of the pattern are 1, 3, 5, 7, 9, 11, 13, 15, 17, 19, 21 and 23. The lower warp yarns shown on the bottom of the pattern are 2, 4, 6, 8, 10, 12, 14, 16, 18, 20, 22 and 24. Upper warp yarns 1, 5, 9, 13, 17 and 21 constitute the upper or first stitching or binding warp yarns and lower warp yarns 2, 6, 10, 14, 18 and 22 constitute the lower or second stitching or binding warp yarns. Upper warp yarns 3, 7, 11, 15, 19 and 23 constitute the upper warp yarns which weave exclusively with the upper layer weft yarns 1-36 and lower warp yarns 4, 8, 12, 16, 20 and 24 constitute the lower warp yarns which weave exclusively with the lower layer weft yarns 1-36. The upper weft yarns shown on the right side of the pattern are 1, 3, 4, 6, 7, 9, 10, 12, 13, 15, 16, 18, 19, 21, 22, 24, 25, 27, 28, 30, 31, 33, 34, and 36. The lower weft yarns shown on the right side of the pattern are 2, 5, 8, 11, 14, 17, 20, 23, 26, 29, 32 and 35.

As was the case in FIG. 1, in FIG. 2, symbol A is shown in locations where upper or first binding warp yarn passes over a top layer weft yarn. Symbol B is shown in locations where lower or second binding warp yarn passes over a top layer weft yarn. Symbol A' is shown in locations where upper or first binding warp yarn passes under a bottom layer weft yarn. Symbol B' is shown in locations where lower or second binding warp yarn passes under a bottom layer weft yarn. Symbol X is shown in locations where an exclusively upper layer warp yarn passes over an upper layer weft yarn. Symbol X' is shown in locations where a exclusively lower layer warp yarn passes under a lower layer weft yarn. Symbol O is shown in locations where an upper layer weft yarn remains uncovered by the upper and lower binding warp yarns. Symbol AB is shown in locations where the upper or first binding warp yarn passes over a top layer weft yarn and the lower or second binding warp yarn passes under a lower layer warp yarn located directly below the top layer weft yarn. Symbol B'A' is shown in locations where the upper or first binding warp yarn passes under a bottom layer weft yarn and the lower or second binding warp yarn passes over an upper layer warp yarn located directly above the bottom layer weft yarn. Symbol XX' is shown in locations where an exclusively upper layer warp yarn passes over an upper layer weft yarn and an exclusively lower layer warp yarn passes under a lower layer weft yarn FIGS. 2A-2L depict the paths of the upper and lower warp yarns 1-24 through the upper and lower weft yarns 1-36. The triple layer fabric of FIG. 2 thus shows a single repeat of the fabric that encompasses 24 warp yarns (yarns 1-24 represented vertically in the right side of the figures) and 36 weft yarns (yarns 1-36 represented horizontally in the figures). While FIGS. 2-2L only show a single repeat unit of the fabric, those of skill in the art will appreciate that in commercial applications the repeat unit shown in FIGS. 2-2L would be repeated many times, in both the warp and weft directions, to form a large fabric suitable for use on a papermaking machine.

As seen in FIG. 2A, the upper or first stitching or binding warp yarn 1 forms a plain weave with upper weft yarns 1, 3, 4, 6, 7, 9 and 10. Thereafter, the upper or first stitching or binding warp yarn 1 crosses to the lower layer by passing underneath upper weft yarns 12, 13 and 15 before weaving with lower weft yarns 17, 20 and 23. That is, the upper or first stitching or binding warp yarn 1 weaves with lower weft yarns 17, 20 and 23 by first passing under lower weft yarn 17, then passing above adjacent lower weft yarn 20, and then passing under lower weft yarn 23. Thus, in the area where the upper or first stitching or binding warp yarn 1 weaves with the lower layer, the binding of the lower layer occurs with a weave instead of with a single binding point as is the case in U.S. Pat. No. 7,059,357 to WARD. Furthermore, the weave of upper binding yarn 1 with lower weft yarns 17, 20 and 23 is a short plain weave. Thereafter, the upper or first stitching or binding warp yarn 1 crosses back over to the upper layer by passing underneath upper weft yarns 24, 25, 27, 28 and 30 before again weaving with a plain weave with upper weft yarns 31, 33, 34 and 36.

Also seen in FIG. 2A, the lower or second stitching or binding warp yarn 2 passes under lower weft yarn 2, then over lower weft yarn 5, then passes under lower weft yarn 8. Thus, in the area where the lower or second stitching or binding warp yarn 2 weaves with the lower layer, the binding of the lower layer occurs with a weave instead of with a single binding point. Thereafter, the lower or second stitching or binding warp yarn 2 crosses to the upper layer by passing underneath upper weft yarns 9, 10 and 12 before weaving with a plain weave with upper weft yarns 13, 15, 16, 18, 19, 21, 22, 24, 25, 27 and 28. Thereafter, the lower or second stitching or binding warp yarn 2 crosses back over to the bottom layer by passing underneath upper weft yarns 30, 31, 33, 34, and 36, before again weaving with other lower weft yarns in another pattern repeat.

As seen in FIG. 2B, the next adjacent upper warp yarn 3 is not a stitching or binding warp yarn and instead weaves exclusively with the top layer weft yarns 1, 3, 4, 6, 7, 9, 10, 12, 13, 15, 16, 18, 19, 21, 22, 24, 25, 27, 28, 30, 31, 33, 34 and 36 and form a plain weave pattern with these top layer weft yarns.

Also seen in FIG. 2B, the next adjacent lower warp yarn 4 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 4 passes under lower weft yarn 2, then passes over lower weft yarns 5 and 8, then passes under lower weft yarn 11, then passes over lower weft yarn 14. Thereafter, the lower warp yarn 4 passes under lower weft yarn 17 before passing over lower weft yarns 20, 23, 26 and 29. Lower warp yarn 4 then passes under lower weft yarn 32, then over lower weft yarn 35.

As seen in FIG. 2C, the next adjacent yarn is another upper or first stitching or binding warp yarn 5 and passes under upper weft yarns 1 and 3, then passes under lower weft yarn 5, then passes above lower weft yarn 8, then under lower weft yarn 11. Thus, in the area where the upper or first stitching or binding warp yarn 5 weaves with the lower layer, the binding of the lower layer occurs with a weave instead of with a single binding point as is the case in U.S. Pat. No. 7,059,357 to WARD. Furthermore, the weave of upper binding yarn 5 with lower weft yarns 5, 8 and 11 is a short plain weave. Thereafter, the upper or first stitching or binding warp yarn 5 crosses to the upper layer by passing underneath upper weft yarns 12, 13, 15, 16 and 18 before weaving with a plain weave to upper weft yarns 19, 21, 22, 24, 25, 27, 28, 30, 31, 33 and 34. Thereafter, the upper or first stitching or binding warp yarn 5 then crosses to the lower layer after first passing beneath upper weft yarn 36.

Also seen in FIG. 2C, the lower or second stitching or binding warp yarn 6 forms a plain weave with upper weft yarns 1, 3, 4, 6, 7, 9, 10, 12, 13, 15 and 16. Thereafter, the lower or second stitching or binding warp yarn 6 crosses to the lower layer by passing underneath upper weft yarns 18, 19, 21, 22 and 24 before weaving with lower weft yarns 26, 29 and 32. Thus, in the area where the lower or second stitching or binding warp yarn 6 weaves with the lower layer, the binding of the lower layer occurs with a weave instead of with a single binding point. Then, the lower or second stitching or binding warp yarn 6 crosses back to the upper layer by first passing underneath upper weft yarns 33, 34, and 36, before again weaving with other upper weft yarns in another pattern repeat.

As seen in FIG. 2D, the next adjacent upper warp yarn 7 is not a stitching or binding warp yarn and instead weaves, with a plain weave, exclusively with the top layer weft yarns 1, 3, 4, 6, 7, 9, 10, 12, 13, 15, 16, 18, 19, 21, 22, 24, 25, 27, 28, 30, 31, 33, 34 and 36.

Also seen in FIG. 2D, the next adjacent lower warp yarn 8 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 8 passes over lower weft yarn 2, then passes under lower weft yarn 5, then passes over lower weft yarns 8, 11, 14 and 17, then passes under lower weft yarn 20. Thereafter, the lower warp yarn 8 passes over lower weft yarn 23 before passing under lower weft yarn 26. Lower warp yarn 8 then passes over lower weft yarns 29 and 32, then under lower weft yarn 35.

As seen in FIG. 2E, the next upper or first stitching or binding warp yarn 9 passes under upper weft yarns 1, 3, 4 and 6, then weaves, with a plain weave, with upper weft yarns 7, 9, 10, 12, 13, 15, 16, 18, 19, 21 and 22. Thereafter, the upper or first stitching or binding warp yarn 9 crosses to the lower layer by passing underneath upper weft yarns 24, 25 and 27 before weaving with lower weft yarns 29, 32 and 35. That is, the upper or first stitching or binding warp yarn 9 weaves with lower weft yarns 29, 32 and 35 by first passing under lower weft yarn 29, then passing above adjacent lower weft yarn 32, and then passing under lower weft yarn 35. Thus, in the area where the upper or first stitching or binding warp yarn 9 weaves with the lower layer, the binding of the lower layer occurs with a weave instead of with a single binding point as is the case in U.S. Pat. No. 7,059,357 to WARD. Furthermore, the weave of upper binding yarn 9 with lower weft yarns 29, 32 and 35 is a short plain weave. Thereafter, the upper or first stitching or binding warp yarn 9 crosses back over to the upper layer by passing underneath upper weft yarn 36 before again weaving with other upper weft yarns in another pattern repeat.

Also seen in FIG. 2E, the lower or second stitching or binding warp yarn 10 weaves, with a plain weave, with upper weft yarns 1, 3 and 4. Thereafter, the lower or second stitching or binding warp yarn 10 crosses to the lower layer by passing underneath upper weft yarns 6, 7, 9, 10 and 12 before weaving with lower weft yarns 14, 17 and 20. That is, the lower or second stitching or binding warp yarn 10 weaves with lower weft yarns 14, 17 and 20 by first passing under lower weft yarn 14, then passing above adjacent lower weft yarn 17, and then passing under lower weft yarn 20. Thus, in the area where the lower or second stitching or binding warp yarn 10 weaves with the lower layer, the binding of the lower layer occurs with a weave instead of with a single binding point.

Then, the lower or second stitching or binding warp yarn 10 crosses back over to the upper layer by passing underneath upper weft yarns 21, 22, and 24, before again weaving, with a plain weave, with the upper weft yarns 25, 27, 28, 30, 31, 33, 34 and 36.

As seen in FIG. 2F, the next adjacent upper warp yarn 11 is not a stitching or binding warp yarn and instead weaves, with a plain weave, exclusively with the top layer weft yarns 1, 3, 4, 6, 7, 9, 10, 12, 13, 15, 16, 18, 19, 21, 22, 24, 25, 27, 28, 30, 31, 33, 34 and 36.

Also seen in FIG. 2F, the next adjacent lower warp yarn 12 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 12 passes over lower weft yarns 2 and 5, then passes under lower weft yarn 8, then passes over lower weft yarn 11, then passes under lower weft yarn 14. Thereafter, the lower warp yarn 11 passes over lower weft yarns 17 and 20 before passing under lower weft yarn 23. Lower warp yarn 12 then passes over lower weft yarn 26, then under lower weft yarn 29. Lower warp yarn 12 then passes over lower weft yarns 32 and 35.

As seen in FIG. 2G, the next adjacent yarn is another upper or first stitching or binding warp yarn 13 weaves, with a plain weave, with upper weft yarns 1, 3, 4, 6, 7, 9 and 10. Thereafter, the upper or first stitching or binding warp yarn 13 crosses to the lower layer by passing underneath upper weft yarns 12, 13 and 15 before weaving with lower weft yarns 17, 20 and 23. Thus, in the area where the upper or first stitching or binding warp yarn 13 weaves with the lower layer, the binding of the lower layer occurs with a weave instead of with a single binding point as is the case in U.S. Pat. No. 7,059,357 to WARD. Furthermore, the weave of upper binding yarn 13 with lower weft yarns 17, 20 and 23 is a short plain weave. Thereafter, the upper or first stitching or binding warp yarn 13 crosses to the upper layer by passing underneath upper weft yarns 24, 25, 27, 28 and 30 before weaving, with a plain weave, with upper weft yarns 31, 33, 34 and 36.

Also seen in FIG. 2G, the lower or second stitching or binding warp yarn 14 passes under lower weft yarn 2, then over lower weft yarn 5, then passes under lower weft yarn 8. The weave of lower binding yarn 14 with lower weft yarns 2, 5 and 8 is a short plain weave. Thereafter, the lower or second stitching or binding warp yarn 14 crosses to the upper layer by passing underneath upper weft yarns 9, 10 and 12. The lower or second stitching or binding warp yarn 14 then weaves, with a plain weave, with upper weft yarns 13, 15, 16, 18, 19, 21, 22, 24, 25, 27 and 28. Then, the upper or first stitching or binding warp yarn 14 crosses to the lower layer by passing underneath upper weft yarns 30, 31, 33, 34 and 36 before weaving with lower weft yarns in another pattern repeat.

As seen in FIG. 2H, the next adjacent upper warp yarn 15 is not a stitching or binding warp yarn and instead weaves, with a plain weave, exclusively with the top layer weft yarns 1, 3, 4, 6, 7, 9, 10, 12, 13, 15, 16, 18, 19, 21, 22, 24, 25, 27, 28, 30, 31, 33, 34 and 36.

Also seen in FIG. 2H, the next adjacent lower warp yarn 16 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 16 passes under lower weft yarn 2, then passes over lower weft yarns 5 and 8, then passes under lower weft yarn 11, then passes over lower weft yarn 14. Thereafter, the lower warp yarn 16 passes under lower weft yarn 17 before passing over lower weft yarns 20, 23, 26 and 29. Lower warp yarn 16 then passes under lower weft yarn 32, then over lower weft yarn 35.

As seen in FIG. 2I, the next adjacent yarn is another upper or first stitching or binding warp yarn 17 and passes under upper weft yarns 1 and 3, then passes under lower weft yarn 5, then passes above lower weft yarn 8, then under lower weft yarn 11. Thus, in the area where the upper or first stitching or binding warp yarn 17 weaves with the lower layer, the binding of the lower layer occurs with a weave instead of with a single binding point as is the case in U.S. Pat. No. 7,059,357 to WARD. Furthermore, the weave of upper binding yarn 17 with lower weft yarns 5, 8 and 11 is a short plain weave. Thereafter, the upper or first stitching or binding warp yarn 17 crosses to the upper layer by passing underneath upper weft yarns 12, 13, 15, 16 and 18 before weaving, with a plain weave, with upper weft yarns 19, 21, 22, 24, 25, 27, 28, 30, 31, 33 and 34. The upper or first stitching or binding warp yarn 17 then crosses to the lower layer after first passing beneath upper weft yarn 36.

Also seen in FIG. 2I, the lower or second stitching or binding warp yarn 18 weaves, with a plain weave, with upper weft yarns 1, 3, 4, 6, 7, 9, 10, 12, 13, 15 and 16 before crossing to the lower layer by passing underneath upper weft yarns 18, 19, 21, 22 and 24. Then, the lower or second stitching or binding warp yarn 18 weaves with lower weft yarns 26, 29 and 32. Thus, in the area where the lower or second stitching or binding warp yarn 18 weaves with the lower layer, the binding of the lower layer occurs with a weave instead of with a single binding point. Then, the lower or second stitching or binding warp yarn 18 crosses back to the upper layer by first passing underneath upper weft yarns 33, 34, and 36, before again weaving with other upper weft yarns in another pattern repeat.

As seen in FIG. 2J, the next adjacent upper warp yarn 19 is not a stitching or binding warp yarn and instead weaves, with a plain weave, exclusively with the top layer weft yarns 1, 3, 4, 6, 7, 9, 10, 12, 13, 15, 16, 18, 19, 21, 22, 24, 25, 27, 28, 30, 31, 33, 34 and 36.

Also seen in FIG. 2J, the next adjacent lower warp yarn 20 is not a stitching or binding warp yarn and instead weaves exclusively with the bottom layer weft yarns 2, 5, 8, 11, 14, 17, 20, 23, 26, 29, 32 and 35 to form a pattern which follows the following course: lower warp yarn 20 passes over lower weft yarn 2, then passes under lower weft yarn 5, then passes over lower weft yarns 8, 11, 14 and 17, and then passes under lower weft yarn 20. Thereafter, the lower warp yarn 20 passes over lower weft yarn 23 before passing under lower weft yarn 26. Lower warp yarn 20 then passes over lower weft yarns 29 and 32, then under lower weft yarn 35.

As seen in FIG. 2K, the next upper or first stitching or binding warp yarn 21 passes under upper weft yarns 1, 3, 4 and 6, then plainly weaves with upper weft yarns 7, 9, 10, 12, 13, 15, 16, 18, 19, 21 and 22. Thereafter, the upper or first stitching or binding warp yarn 21 crosses to the lower layer by passing underneath upper weft yarns 24, 25 and 27 before weaving with lower weft yarns 29, 32 and 35. That is, the upper or first stitching or binding warp yarn 21 weaves with lower weft yarns 29, 32 and 35 by first passing under lower weft yarn 29, then passing above adjacent lower weft yarn 32, and then passing under lower weft yarn 35. Thus, in the area where the upper or first stitching or binding warp yarn 21 weaves with the lower layer, the binding of the lower layer occurs with a weave instead of with a single binding point as is the case in U.S. Pat. No. 7,059,357 to WARD. Furthermore, the weave of upper binding yarn 21 with lower weft yarns 29, 32 and 35 is a short plain weave. Thereafter, the upper or first stitching or binding warp yarn 21 crosses back over to the upper layer by passing underneath upper weft yarn 36 before again weaving with other upper weft yarns in another pattern repeat.

Also seen in FIG. 2K, the lower or second stitching or binding warp yarn 22 plainly weaves with upper weft yarns 1, 3 and 4. Thereafter, the lower or second stitching or binding warp yarn 22 crosses to the lower layer by passing underneath upper weft yarns 6, 7, 9, 10 and 12 before weaving with lower weft yarns 14, 17 and 20. That is, the lower or second stitching or binding warp yarn 22 weaves with lower weft yarns 14, 17 and 20 by first passing under lower weft yarn 14, then passing above adjacent lower weft yarn 17, and then passing under lower weft yarn 20. Thus, in the area where the lower or second stitching or binding warp yarn 22 weaves with the lower layer, the binding of the lower layer occurs with a weave instead of with a single binding point. Thereafter, the lower or second stitching or binding warp yarn 22 crosses back over to the upper layer by passing underneath upper weft yarns 21, 22 and 24, before again weaving with the upper weft yarns. Here, the lower or second stitching or binding warp yarn 22 plainly weaves with upper weft yarns 25, 27, 28, 30, 31, 33, 34 and 36.

As seen in FIG. 2L, the next adjacent upper warp yarn 23 is not a stitching or binding warp yarn and instead plainly weaves exclusively with the top layer weft yarns 1, 3, 4, 6, 7, 9, 10, 12, 13, 15, 16, 18, 19, 21, 22, 24, 25, 27, 28, 30, 31, 33, 34 and 36.

Also seen in FIG. 2L, the next adjacent lower warp yarn 24 is not a stitching or binding warp yarn and instead weaves exclusively with the bottom layer weft yarns 2, 5, 8, 11, 14, 17, 20, 23, 26, 29, 32 and 35 to form a pattern which follows the following course; lower warp yarn 24 passes over lower weft yarns 2 and 5, then passes under lower weft yarn 8, then passes over lower weft yarn 11, then passes under lower weft yarn 14. Thereafter, the lower warp yarn 24 passes over lower weft yarns 17 and 20 before passing under lower weft yarn 23. Lower warp yarn 24 then passes over lower weft yarn 26, then under lower weft yarn 29. Then, the lower warp yarn 24 passes over lower weft yarns 32 and 35.

By way of non-limiting example, the top layer weft yarns 1, 3, 4, 6, 7, 9, 10, 12, 13, 15, 16, 18, 19, 21, 22, 24, 25, 27, 28, 30, 31, 33, 34 and 36 of the embodiment shown in FIGS. 2-2L can have the following characteristics: acceptable size range of between approximately 0.10 mm and approximately 0.30 mm, preferable size ranges of between approximately 0.15 mm and approximately 0.25 mm, and most preferred size range of between approximately 0.18 mm and approximately 0.22 mm. The material for these yarns can be any natural or synthetic material, is preferably a synthetic monofilament, and is most preferably a polyester monofilament.

By way of non-limiting example, the bottom layer weft yarns 2, 5, 8, 11, 14, 17, 20, 23, 26, 29, 32 and 35 of the embodiment shown in FIGS. 2-2L can have the following characteristics: acceptable size range of between approximately 0.20 mm and approximately 0.40 mm, preferable size ranges of between approximately 0.25 mm and approximately 0.35 mm, and most preferred size range of between approximately 0.28 mm and approximately 0.32 mm. The material for these yarns can be any natural or synthetic material, is preferably a synthetic monofilament, and is most preferably a polyester monofilament. The bottom weft yarns can preferably be constructed using relatively large diameter yarns that are well suited to sustain the wear caused by the friction between the machine side surface of the fabric and the papermaking machine during use of the fabric.

By way of non-limiting example, the upper warp yarns 1, 3, 5, 7, 9, 11, 13, 15, 17, 19, 21 and 23 of the embodiment shown in FIGS. 2-2L can have the following characteristics: acceptable size range of between approximately 0.10 mm and approximately 0.30 mm, preferable size ranges of between approximately 0.15 mm and approximately 0.25 mm, and most preferred size range of between approximately 0.18 mm and approximately 0.22 mm. The material for these yarns can be any natural or synthetic material, is preferably a synthetic monofilament, and is most preferably a polyester monofilament.

By way of non-limiting example, the lower warp yarns 2, 4, 6, 8, 10, 12, 14, 16, 18, 20, 22 and 24 of the embodiment shown in FIGS. 2-2L can have the following characteristics: acceptable size range of between approximately 0.20 mm and approximately 0.40 mm, preferable size ranges of between approximately 0.25 mm and approximately 0.35 mm, and most preferred size range of between approximately 0.28 mm and approximately 0.32 mm. The material for these yarns can be any natural or synthetic material, is preferably a synthetic monofilament, and is most preferably a polyester monofilament. These bottom warp yarns may also be constructed using larger diameter yarns than the upper warp yarns.

In the embodiment shown in FIGS. 2-2L, only 50% of the warp yarns (i.e., 12 out of the 24 warp yarns in each repeat of the fabric) weave in both the top fabric layer and the bottom fabric layer. As a result of this configuration, improved "stacking" of the yarns running in the warp direction may be obtained. The stacked warp yarn arrangement of fabric can provide straight-through drainage—a desired fabric feature in many papermaking applications—as water reaching the top surface of the top fabric layer meets relatively small drainage holes between the yarns that go straight through to the bottom of the bottom fabric layer. Additionally, by having less than 100% of the warp yarns weaving in both the top and bottom fabric layers, it is generally possible to reduce the yarn mass within the fabric, thereby providing a fabric having increased permeability and a higher void volume than an equivalent fabric formed with 100% of the warp yarns configured as stitching yarns. These features are also desirable in numerous papermaking applications.

The invention encompasses a variety of different types of fabrics. For instance, the invention noted herein encompasses fabrics woven with different repeat than that pictured and described above. The fabric can have various top to bottom weft yarn ratios. The invention further contemplates other multilayer fabrics, and not just the "true" triple layer fabrics depicted in the figures.

As noted above, certain embodiments of the present invention are directed to "true" triple layer fabrics—meaning triple layer fabrics that include (1) a set of warp yarns and a set of weft yarns that each weave exclusively in a top fabric layer, (2) a set of warp yarns and a set of weft yarns that each weave exclusively in a bottom fabric layer and (3) stitching warp yarn pairs that stitch the top and bottom fabric layers together. Pursuant to the teachings of the present invention, it will be appreciated that the warp-stitched true triple layer fabrics may have improved stacking, increased permeability and higher fiber support as compared to double layer fabrics. Additionally, by using stitching warp yarn pairs that complete the weave in the papermaking surface, it is possible to bind the fabric together at numerous locations, thereby providing a very stable fabric that is resistant to interlayer wear. The fabric particularly advantageously has a large number of drainage openings for causing drainage markings on the paper web. That is, the fabric has a larger number of smaller openings or holes instead of a smaller number of larger holes as in the prior art.

Those of skill in the art will likewise appreciate that the stitching warp yarn pairs need not be included between every adjacent pair of top warp yarns. Instead, a stitching warp yarn pair may be provided after every second, third, fourth or fifth top warp yarn. Additionally, the top warp yarns themselves could be replaced by stitching warp yarn pairs in certain embodiments of the present invention. Those of skill in the art will also appreciate that the frequency of interlacing can be varied from that shown in the fabrics pictured herein. However, the stitching warp yarns should sufficiently bind the upper and lower fabric layers together to prevent excessive movement between the fabric layers, as such excessive movement could result in inter-layer wear problems.

The fabrics pictured and otherwise described and claimed herein may be employed in a variety of applications, including fine paper grades, tissue paper, brown paper and newsprint, but is especially beneficial for fine paper, newsprint and brown paper applications.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the mesh of the papermaking surface. In a typical embodiment of the triple layer fabrics disclosed herein, preferably the diameter of the top weft yarns, the top warp yarns and the stitching warp yarns is between about 0.10 and 0.22 mm, the diameter of the bottom warp yarns is between about 0.14 and 0.27 mm, and the diameter of the bottom weft yarns is between about 0.18 and 0.50 mm. Those of skill in the art will appreciate that yarns having diameters outside the above ranges may be used in certain applications. In one embodiment of the present invention, the top weft yarns, the top warp yarns and the stitching warp yarns have diameters of about 0.13 mm, and the diameter of the bottom warp yarns is about 0.17 mm. In this embodiment the diameter of the bottom weft yarns is between about 0.33 and 0.36 mm. The total top finished end count on this fabric is 34 ends per centimeter. Fabrics employing these yarn sizes may be implemented with polyester yarns or with a combination of polyester and nylon yarns.

The fabrics of the present invention have been described herein are flat woven fabrics and hence the warp yarns for these fabrics run in the machine direction (a direction aligned with the direction of travel of the papermakers' fabric on the papermaking machine) when the fabric is used on a papermaking machine and the weft yarns for these fabrics run in the cross machine direction (a direction parallel to the fabric surface and traverse to the direction of travel) when the fabric is used on a papermaking machine. However, those of skill in the art will appreciate that the fabrics of the present invention could also be woven using an endless weaving process. If such endless weaving were used, the warp yarns would run in the cross machine direction and the weft yarns would run in the machine direction when the fabric was used on a papermaking machine.

Pursuant to another aspect of the present invention, methods of making triple layer papermaker's fabrics are provided. Pursuant to these methods, the fabrics are woven using three separate warp beams. Warp yarns that weave exclusively in the top fabric layer are provided off of the first warp beam. Warp yarns that weave exclusively in the bottom fabric layer are woven off of the second warp beam. Warp yarns that weave in both the top and bottom fabric layers are woven off of the third beam. The warp yarns on the second beam preferably have a larger diameter than the warp yarns woven off the first beam. Additionally, the warp yarns woven off the third beam may differ from the warp yarns woven off both the first and second warp beams, e.g., they might have a lower modulus of elasticity.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paperstock is well understood by those of skill in the art, additional details regarding this aspect of the present invention will not be provided herein.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A forming fabric comprising:

a top layer comprising a plurality of first top warp yarns woven with a plurality of top weft yarns;

a bottom layer comprising a plurality of first bottom warp yarns woven with a plurality of bottom weft yarns;

a plurality of second top warp yarns woven with some of the plurality of top weft yarns and with some of the plurality of bottom weft yarns;

a plurality of second bottom warp yarns woven with some of the plurality of top weft yarns and with some of the plurality of bottom weft yarns;

at least one of the plurality of second top warp yarns being woven to the bottom layer with a short plain weave; and at least one of the plurality of second bottom warp yarns being woven to the bottom layer with a short plain weave, wherein each of the plurality of second top warn yarns and each of the plurality of second bottom warp yarns:

passes under between 3 and 6 adjacent top weft yarns when passing between the top and bottom layers; and weaves with three adjacent bottom weft yarns with the short plain weave.

2. The fabric of claim 1, wherein the forming fabric is a warp-stitched triple layer papermaker's fabric.

3. The fabric of claim 1, wherein the top layer has a papermaking surface and the bottom has a machine side surface.

4. The fabric of claim 1, wherein the short plain weave comprises at least three adjacent bottom weft yarns per repeat.

5. The fabric of claim 1, wherein the short plain weave comprises only three adjacent bottom weft yarns per repeat.

6. The fabric of claim 1, wherein each of the plurality of second top warp yarns and each of the plurality of second bottom warp yarns weaves to the bottom layer with a short plain weave.

7. The fabric of claim 6, wherein the short plain weave comprises at least three adjacent bottom weft yarns per repeat.

8. The fabric of claim 6, wherein the short plain weave comprises only three adjacent bottom weft yarns per repeat.

9. The fabric of claim 1, wherein the at least one of the plurality of second top warp yarns and the at least one of the plurality of second bottom warp yarns are vertically stacked one above the other.

10. The fabric of claim 1, wherein the at least one of the plurality of second top warp yarns and the at least one of the plurality of second bottom warp yarns comprise stitching or binding warp yarns.

11. The fabric of claim 10, wherein the stitching or binding warp yarns differ from the plurality of first top and bottom warp yarns in at least one of the following characteristics:

size;

modulus;

material.

12. The fabric of claim 1, wherein at least one of the plurality of first top warp yarns differ from at least one of the plurality of first bottom warp yarns in at least one of the following characteristics:

size;

modulus;

material.

13. The fabric of claim 1, wherein the at least one of the plurality of second top warp yarns differs from the at least one of the plurality of second bottom warp yarns in at least one of the following characteristics:

size;

modulus;

material.

14. The fabric of claim 1, wherein the at least one of the plurality of second top warp yarns is smaller in size than the at least one of the plurality of second bottom warp yarns.

15. The fabric of claim 1, wherein the at least one of the plurality of second top warp yarns comprises a diameter of approximately 0.18 mm and the at least one of the plurality of second bottom warp yarns comprises a diameter of approximately 0.27 mm.

16. The fabric of claim 1, wherein a ratio of a size of the at least one of the plurality of second top warp yarns relative to the at least one of the plurality of second bottom warp yarns is between approximately 1:1.25 to approximately 1:2.25.

17. The fabric of claim 16, wherein the ratio is between approximately 1:1.5 to approximately 1:2.

18. The fabric of claim 1, wherein the forming fabric has a warp ration of between approximately 2:1 to approximately 3:2.

19. The fabric of claim 1, wherein the at least one of the plurality of second top warp yarns and the at least one of the plurality of second bottom warp yarns comprise vertically stacked stitching or binding warp yarns of different sizes.

20. The fabric of claim 1, wherein the top layer comprises a plain weave.

21. The fabric of claim 1, wherein the top layer comprises a textured weave.

22. A forming fabric comprising:

a top layer comprising a plurality of top warp yarns woven with a plurality of top weft yarns;

a bottom layer comprising a plurality of bottom warp yarns woven with a plurality of bottom weft yarns;

a plurality of first binding warp yarns woven with some of the plurality of top weft yarns and with some of the plurality of bottom weft yarns;

a plurality of second binding warp yarns woven with some of the plurality of top weft yarns and with some of the plurality of bottom weft yarns;

at least one of the plurality of first binding warp yarns being woven to the bottom layer with a short plain weave;

at least one of the plurality of second binding warp yarns being woven to the bottom layer with a short plain weave; and the at least one of the plurality of first binding warp yarns and the at least one of the plurality of second binding warp yarns being vertically stacked, wherein each of the plurality of first binding warp yarns and each of the plurality of second binding warp yarns:

passes under between 3 and 6 adjacent top weft yarns when passing between the top and bottom layers; and weaves with three adjacent bottom weft yarns with the short plain weave.

23. The fabric of claim 22, wherein the plurality of top warp yarns and the plurality of bottom warp yarns are vertically stacked and wherein the plurality of top weft yarns and the plurality of bottom weft yarns are vertically stacked.

24. A forming fabric comprising:

a top layer comprising a plurality of top warp yarns woven with a plurality of top weft yarns;

a bottom layer comprising a plurality of bottom warp yarns woven with a plurality of bottom weft yarns;

the plurality of top warp yarns and the plurality of bottom warp yarns being vertically stacked;

a plurality of first binding warp yarns woven with some of the plurality of top weft yarns and with some of the plurality of bottom weft yarns;

a plurality of second binding warp yarns woven with some of the plurality of top weft yarns and with some of the plurality of bottom weft yarns;

at least one of the plurality of first binding warp yarns being woven to the bottom layer with a short plain weave;

at least one of the plurality of second binding warp yarns being woven to the bottom layer with a short plain weave; and the at least one of the plurality of first binding warp yarns and the at least one of the plurality of second binding warp yarns being vertically stacked, wherein each of the plurality of first binding warp yarns and each of the plurality of second binding warp yarns:

passes under between 3 and 6 adjacent top weft yarns when passing between the top and bottom layers; and weaves with three adjacent bottom weft yarns with the short plain weave.

25. A method of making the fabric of claim 24, comprising:

weaving together the top and bottom layers with the at least one of the plurality of first binding warp yarns and the at least one of the plurality of second binding warp yarns.

26. A method of making the fabric of claim 1, comprising:

weaving together the top and bottom layers with the at least one of the plurality of first binding warp yarns and the at least one of the plurality of second binding warp yarns.

27. A method of making the fabric of claim 22, comprising:

weaving together the top and bottom layers with the at least one of the plurality of first binding warp yarns and the at least one of the plurality of second binding warp yarns.

* * * * *